US010782622B2

(12) United States Patent
Zhu et al.

(10) Patent No.: US 10,782,622 B2
(45) Date of Patent: Sep. 22, 2020

(54) PHOTORECEPTOR FOR ELECTROPHOTOGRAPHY, METHOD FOR MANUFACTURING THE SAME, AND ELECTROPHOTOGRAPHIC DEVICE

(71) Applicant: FUJI ELECTRIC CO., LTD., Kawasaki-shi, Kanagawa (JP)

(72) Inventors: Fengqiang Zhu, Matsumoto (JP); Shinjiro Suzuki, Matsumoto (JP); Toshiki Takeuchi, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/723,129

(22) Filed: Oct. 2, 2017

(65) Prior Publication Data

US 2018/0024449 A1 Jan. 25, 2018

Related U.S. Application Data

(63) Continuation of application No. PCT/JP2015/080836, filed on Oct. 30, 2015.

(51) Int. Cl.
*G03G 5/05* (2006.01)
*G03G 5/06* (2006.01)
(Continued)

(52) U.S. Cl.
CPC ..... *G03G 5/056* (2013.01); *G03G 5/047* (2013.01); *G03G 5/0525* (2013.01);
(Continued)

(58) Field of Classification Search
CPC .. G03G 5/0612; G03G 5/0609; G03G 5/0631; G03G 5/0603; G03G 5/056; G03G 5/0578; G03G 5/0589; G03G 5/14752
(Continued)

(56) References Cited

U.S. PATENT DOCUMENTS 3,484,237 A 12/1969 Shattuck et al.
3,684,502 A 8/1972 Gramza et al.
(Continued)

FOREIGN PATENT DOCUMENTS

CN 102301284 A 12/2011
JP S47-10785 A 5/1972
(Continued)

OTHER PUBLICATIONS

Diamond, A.S., ed., Handbook of Iniaging Materials, Marcel Dekker, Inc., NY (1991), pp. 395-396 (Year: 1991).*
(Continued)

*Primary Examiner* — Thorl Chea
(74) *Attorney, Agent, or Firm* — Rabin & Berdo, P.C.

(57) ABSTRACT

A photoreceptor for electrophotography, a method for manufacturing the photoreceptor, and an electrophotographic device including the photoreceptor are disclosed. The photoreceptor for electrophotography includes a conductive substrate; and a photosensitive layer that is provided on the conductive substrate and that has an outermost surface layer containing at least a resin binder and an electron transport material. The resin binder is composed of a polyarylate resin having a structural unit represented by a Chemical Structural Formula 1, and the electron transport material is composed of a compound having a structure represented by a Structural Formula (ET2-3). The photoreceptor has high sensitivity, low residual electric potential, no light fatigue and sufficient stain resistance.

16 Claims, 2 Drawing Sheets

(51) Int. Cl.
*G03G 5/047* (2006.01)
*G03G 5/147* (2006.01)
*G03G 15/00* (2006.01)

(52) U.S. Cl.
CPC ..... *G03G 5/0578* (2013.01); *G03G 5/0589* (2013.01); *G03G 5/0603* (2013.01); *G03G 5/0605* (2013.01); *G03G 5/0609* (2013.01); *G03G 5/0612* (2013.01); *G03G 5/0631* (2013.01); *G03G 5/0677* (2013.01); *G03G 15/75* (2013.01); *G03G 15/751* (2013.01)

(58) Field of Classification Search
USPC ..... 430/58.55, 58.26, 59.2, 59.6, 66, 67
See application file for complete search history.

(56) References Cited

U.S. PATENT DOCUMENTS

| | | | | |
|---|---|---|---|---|
| 6,890,693 | B2 * | 5/2005 | Zhu | G03G 5/047 399/162 |
| 2004/0142261 | A1 | 7/2004 | Kiuchi et al. | |
| 2006/0068310 | A1 | 3/2006 | Nozomi et al. | |
| 2008/0159791 | A1 | 7/2008 | Urano et al. | |
| 2009/0123854 | A1 * | 5/2009 | Itami | G03G 5/14756 430/48 |
| 2010/0178074 | A1 | 7/2010 | Nakatake et al. | |
| 2012/0058422 | A1 | 3/2012 | Suzuki et al. | |
| 2015/0079510 | A1 * | 3/2015 | Zhu | G03G 5/056 430/58.2 |
| 2016/0282732 | A1 * | 9/2016 | Shimizu | G03G 5/0614 |

FOREIGN PATENT DOCUMENTS

| | | | | |
|---|---|---|---|---|
| JP | S47-37543 | A | 12/1972 | |
| JP | S58-160957 | A | 9/1983 | |
| JP | S58-163946 | A | 9/1983 | |
| JP | H11-160958 | A | 6/1999 | |
| JP | 2003-120658 | A | 4/2003 | |
| JP | 2004-206109 | A | 7/2004 | |
| JP | 2008-164757 | A | 7/2008 | |
| JP | 2010164639 | A | 7/2010 | |
| JP | 2010211020 | A | 9/2010 | |
| JP | 2015-94839 | A | 5/2015 | |
| JP | 2015-143776 | A | 8/2015 | |
| WO | WO-02/081452 | A1 | 10/2002 | |
| WO | WO-2010/092695 | A1 | 8/2010 | |
| WO | WO-2013128575 | A1 * | 9/2013 | G03G 5/056 |

OTHER PUBLICATIONS

Verified English-translation of priority document, Japanese Patent Application 2015-060603, filed in U.S. Appl. No. 15/077,144 dated Dec. 22, 2017. US 2016/0282732 A1 is the U.S. Appl. No. 15/077,144. (Year: 2015).*

* cited by examiner

PHOTORECEPTOR FOR ELECTROPHOTOGRAPHY, METHOD FOR MANUFACTURING THE SAME, AND ELECTROPHOTOGRAPHIC DEVICE

CROSS-REFERENCE TO RELATED APPLICATIONS

This application is a continuation of PCT Application No. PCT/JP2015/080836 filed Oct. 30, 2015, the entire contents of which are incorporated herein by reference.

BACKGROUND OF THE INVENTION

1. Field of the Invention

The present invention relates to a photoreceptor for electrophotography (hereinafter, also simply referred to as "photoreceptor") used for electrophotographic printers, copying machines, fax machines, and the like, a method for manufacturing the same, and an electrophotographic device, and in particular, to a photoreceptor for electrophotography having high sensitivity, low residual electric potential, no light fatigue, and favorable stain resistance by combining a polyarylate resin and a specific electron transport material, a method for manufacturing the same, and an electrophotographic device.

2. Background of the Related Art

Photoreceptors for electrophotography demand a function to retain surface charge in a dark place, a function to receive light to generate electric charge, and a function to receive light as well to transport electric charge, and examples thereof include a so-called single-layer photoreceptor having these functions in one layer and a so-called multi-layer photoreceptor in which a layer mainly contributing to charge generation and a layer contributing to retention of surface charge in a dark place and electric charge transport during light reception whose functions are separated are layered.

To image formation by an electrophotographic method using such photoreceptors for electrophotography, for example, the Carlson method is applied. Image formation by this method is performed by charging of a photoreceptor in a dark place, formation of an electrostatic image such as a character or a picture on the surface of the charged photoreceptor, development of the formed electrostatic image by toner, and transfer fixing of the developed toner image to a support such as a paper. After transferring the toner image, the photoreceptor is subjected to reuse after removal of residual toner, electric charge removing, or the like.

For a material of the above-described photoreceptor for electrophotography, an inorganic photoconductive material such as selenium, a selenium alloy, zinc oxide, or cadmium sulfide dispersed in a resin binder, an organic photoconductive material such as poly-N-vinylcarbazole, 9,10-anthracenediol polyester, pyrazoline, hydrazone, stilbene, butadiene, benzidine, phthalocyanine, or bisazo compound dispersed in a resin binder, vacuum deposited, or sublimed, or the like is used.

In recent years, photoreceptors for electrophotography using an organic material have been put into practical use due to advantages such as flexibility, thermal stability, and film forming properties. Examples thereof include a photoreceptor composed of a poly-N-vinylcarbazole and 2,4,7-trinitoluolene-9-one (described in Patent Document 1), a photoreceptor containing an organic pigment as a main component (described in Patent Document 2), and a photoreceptor containing a eutectic complex composed of a dye and a resin as a main component (described in Patent Document 3).

Recently, a functionally separated multi-layer photoreceptor in which a photosensitive layer is formed by layering a charge generation layer containing an electric charge generating material and a charge transport layer containing an electric charge transport material has become mainstream. Above all, there have been proposed a number of negatively charged organic photoreceptors obtained by using a layer in which an organic pigment as an electric charge generating material is dispersed in a deposition layer or a resin as a charge generation layer and using an organic low molecular compound as an electric charge transport material to layer a charge transport layer on the charge generation layer.

Organic materials have many advantages not found in inorganic materials, but have not been able to satisfy all the properties demanded for photoreceptors for electrophotography. In other words, deterioration of image quality is caused by a decrease in charged electric potential due to repeated use, an increase in residual potential, a change in sensitivity, or the like. The cause of this deterioration is not completely understood, but as a factor, it is conceivable that a resin is photo-deteriorated, an electric charge transport material is decomposed, or the like by repetitive exposure to image exposure light and charge removing lamp light or exposure to external light during maintenance.

In order to suppress such deterioration due to light, proposals have been made to add a dye or an ultraviolet absorber to a surface protective layer or a photosensitive layer of a photoreceptor. For example, Patent Document 4 describes adding a dye or an ultraviolet absorber having an absorption characteristic including an absorption wavelength region possessed by a charge transport layer in a surface protective layer. Patent Document 5 describes adding a yellow dye to a charge transport layer.

Further, stain resistance of the surface of a photoreceptor is also strictly demanded. Although a polycarbonate resin is mainly used as a binder resin in a surface layer of a photoreceptor, a polyarylate resin is also used. Since a photoreceptor always contacts a charging roller or a transfer roller, the surface of the photoreceptor is contaminated by components of members constituting such rollers, and black streaks are generated in a halftone image, which is problematic.

With respect to the stain resistance, a method in which a resin containing an ethylene-butylene copolymer is used for a resistance layer of a charging roller described in Patent Document 6 and a method in which a rubber composition containing epichlorohydrin rubber as a main rubber component and a filler is used for a transfer roller described in Patent Document 7 have been proposed. As described in Patent Document 8, a method in which a rubber composition having a sea-island structure in which an island phase of a rubber component B composed mainly of epichlorohydrin rubber is dispersed in a sea phase of a rubber component A composed mainly of acrylonitrile butadiene rubber is used for an electroconductive roller has been proposed. Further, as described in Patent Document 9, a method in which, in an electroconductive roller with a rubber layer formed on an electroconductive core member, the rubber material of the rubber layer is composed of a polymer containing acrylonitrile butadiene rubber as a main component and a sulfur and chlorine-free sub is contained in 20 parts by mass or more with respect to 100 parts by mass of acrylonitrile butadiene rubber has been proposed. However, these methods failed to sufficiently respond to the stain resistance.

Regarding the stain resistance, a polyarylate resin exhibits favorable stain resistance results as compared with a polycarbonate resin in the outermost surface layer of a photoreceptor, but on the other hand, there is concern that degradation by light may occur. Specifically, the polyarylate resin has a high ultraviolet absorbing ability, absorbs ultraviolet energy, causes a Fries rearrangement reaction, and forms a benzophenone structure in a resin surface layer portion, and therefore, the resin is weak against light resistance.

Related patent documents discussed herein include Patent Document 1: U.S. Pat. No. 3,484,237; Patent Document 2: Japanese Unexamined Patent Application Publication No. 47-37543; Patent Document 3: Japanese Unexamined Patent Application Publication No. 47-10785; Patent Document 4: Japanese Unexamined Patent Application Publication No. 58-160957; Patent Document 5: Japanese Unexamined Patent Application Publication No. 58-163946; Patent Document 6: Japanese Unexamined Patent Application Publication No. 11-160958; Patent Document 7: Japanese Unexamined Patent Application Publication No. 2008-164757; Patent Document 8: Japanese Unexamined Patent Application Publication No. 2010-211020; and Patent Document 9: Japanese Unexamined Patent Application Publication No. 2003-120658.

As described above, a variety of techniques have ever been proposed for improving a photoreceptor. However, sufficient effects have not been obtained even by the above-described conventional techniques. Further, in a technique of adding a dye or an ultraviolet absorber as described above, there has also been a problem that sensitivity reduction, residual electric potential increase, and the like are caused.

Accordingly, an object of the present invention is to provide a photoreceptor for electrophotography having high sensitivity, low residual electric potential, no light fatigue and sufficient stain resistance, a method for manufacturing the same and electrophotographic device in order to solve the above-described problems.

SUMMARY OF THE INVENTION

In order to solve the above problems, the present inventors have intensively studied to find that, by using a polyarylate resin for the outermost surface layer of a photoreceptor and adding a specific electron transport material, a photoreceptor with high sensitivity, low residual potential, no light fatigue, penetration of a component which leaks from a constituent member of a charging roller or a transfer roller into the surface of a photoreceptor suppressed, and stain resistance improved can be obtained, thereby completing the present invention.

Specifically, the photoreceptor for electrophotography of the present invention is a photoreceptor for electrophotography comprising at least a photosensitive layer on a conductive substrate, characterized in that an outermost surface layer contains at least a resin binder and an electron transport material, the resin binder contains a polyarylate resin having a structural unit represented by the following Chemical Structural Formula 1, and the electron transport material contains a compound having a structure represented by the following General Formula (ET2), Chemical Structural Formula 1:

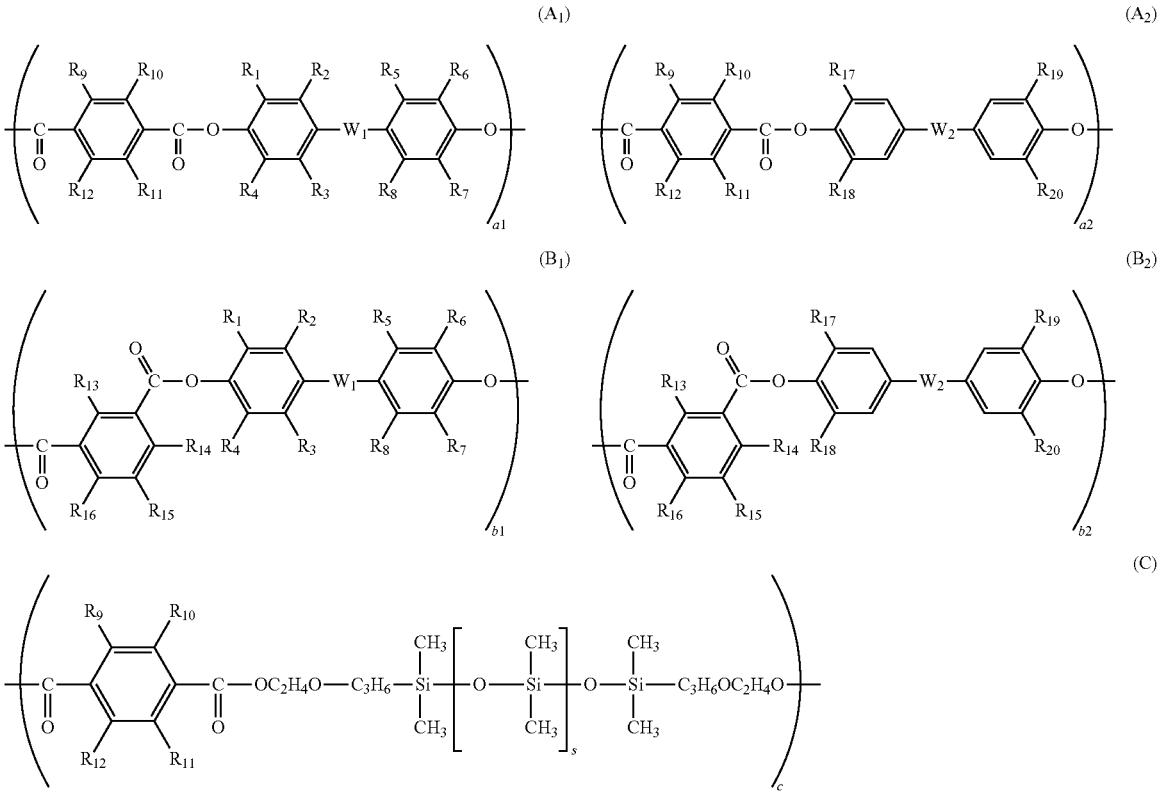

-continued (D)

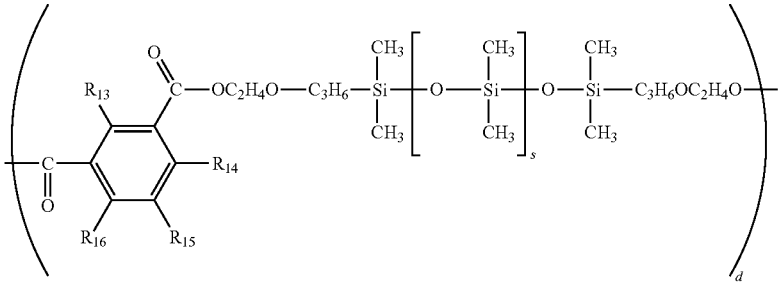

(E)

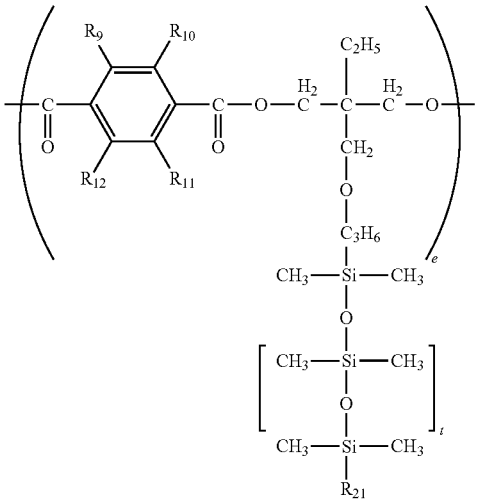

(F)

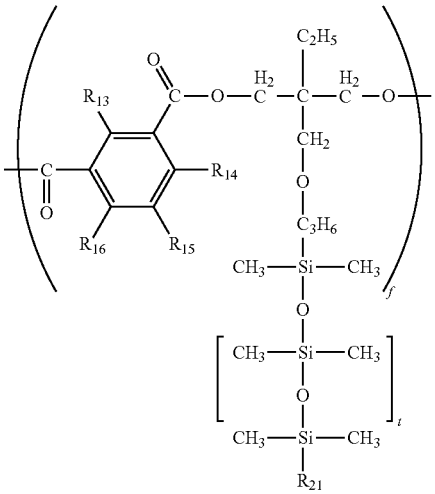

where, in Chemical Structural Formula 1, partial structural formulae ($A_1$), ($A_2$), ($B_1$), ($B_2$), (C), (D), (E), and (F) represent structural units constituting the resin binder, each of $a_1$, $a_2$, $b_1$, $b_2$, c, d, e, and f represents mol % of each of structural units ($A_1$), ($A_2$), ($B_1$), ($B_2$), (C), (D), (E), and (F), $a_1+a_2+b_1+b_2+c+d+e+f$ is 100 mol %, and c+d+e+f is from 0 to 10 mol %; $W_1$ and $W_2$ are different and are selected from the group consisting of a single bond, —O—, —S—, —SO—, —CO—, —$SO_2$—, and —$CR_{22}R_{23}$—, where $R_{22}$ and $R_{23}$ are the same or different and each represents a hydrogen atom, an alkyl group having from 1 to 12 carbon atoms, a halogenated alkyl group, or a substituted or unsubstituted aryl group having from 6 to 12 carbon atoms), a substituted or unsubstituted cycloalkylidene group having from 5 to 12 carbon atoms, a substituted or unsubstituted α,ω-alkylene group having from 2 to 12 carbon atoms, a -9,9-fluorenylidene group, a substituted or unsubstituted arylene group having 6 to 12 carbon atoms, and a divalent group containing an aryl group or arylene group having from 6 to 12 carbon atoms; $R_1$ to $R_{20}$, which are the same or different, each represent a hydrogen atom, an alkyl group having from 1 to 8 carbon atoms, a fluorine atom, a chlorine atom, or a bromine atom; $R_{21}$ represents a hydrogen atom, an alkyl group having from 1 to 20 carbon atoms, an aryl group optionally containing a substituent, a cycloalkyl group optionally containing a substituent, a fluorine atom, a chlorine atom, or a bromine atom. s and t each represent an integer of 1 or more, and General Formula (ET2):

(ET2)

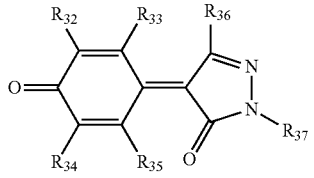

where, in the General Formula (ET2), $R_{32}$ to $R_{37}$ are the same or different and each represent a hydrogen atom, a halogen atom, a cyano group, a nitro group, a hydroxyl group, an alkyl group having from 1 to 12 carbon atoms, an alkoxy group having from 1 to 12 carbon atoms, an aryl group which may have a substituent, a heterocyclic group which may have a substituent, an ester group, a cycloalkyl group, an aralkyl group which may have a substituent, an allyl group, an amido group, an amino group, an acyl group, an alkenyl group, an alkynyl group, a carboxyl group, a carbonyl group, a carboxylic acid group, or a halogenated alkyl group; the substituent represents a halogen atom, an alkyl group having from 1 to 6 carbon atoms, an alkoxy group having from 1 to 6 carbon atoms, a hydroxyl group, a cyano group, an amino group, a nitro group, or a halogenated alkyl group.

In the photoreceptor of the present invention, preferably, the electron transport material further contains one or both of compounds having a structure represented by the following General Formulae (ET1) or (ET3), (ET1)

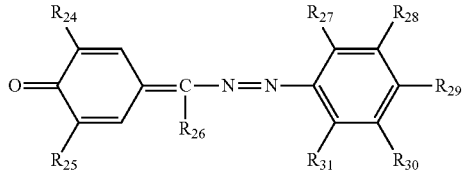

where, in the General Formula (ET1), $R_{24}$ and $R_{25}$ are the same or different and each represents a hydrogen atom, an alkyl group having from 1 to 12 carbon atoms, an alkoxy group having from 1 to 12 carbon atoms, an aryl group optionally containing a substituent, a cycloalkyl group, an aralkyl group optionally containing a substituent, or a halogenated alkyl group. $R_{26}$ represents a hydrogen atom, an alkyl group having from 1 to 6 carbon atoms, an alkoxy group having from 1 to 6 carbon atoms, an aryl group optionally containing a substituent, a cycloalkyl group, an aralkyl group optionally containing a substituent, or a halogenated alkyl group. $R_{27}$ to $R_{31}$ are the same or different and each represent a hydrogen atom, a halogen atom, an alkyl group having from 1 to 12 carbon atoms, an alkoxy group having from 1 to 12 carbon atoms, an aryl group optionally containing a substituent, an aralkyl group optionally containing a substituent, a phenoxy group optionally containing a substituent, a halogenated alkyl group, a cyano group, or a nitro group, and two or more groups may be bonded to each other to form a ring; the substituent represents a halogen atom, an alkyl group having from 1 to 6 carbon atoms, an alkoxy group having from 1 to 6 carbon atoms, a hydroxyl group, a cyano group, an amino group, a nitro group, or a halogenated alkyl group, and (ET3)

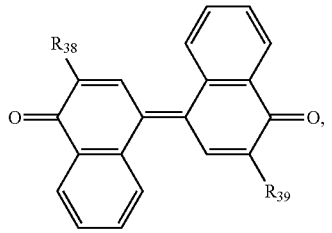

where, in the General Formula (ET3), $R_{38}$ and $R_{39}$ are the same or different and each represents a hydrogen atom, a halogen atom, a cyano group, a nitro group, a hydroxyl group, an alkyl group having from 1 to 12 carbon atoms, an alkoxy group having from 1 to 12 carbon atoms, an aryl group optionally containing a substituent, a heterocyclic group optionally containing a substituent, an ester group, a cycloalkyl group, an aralkyl group optionally containing a substituent, an allyl group, an amido group, an amino group, an acyl group, an alkenyl group, an alkynyl group, a carboxyl group, a carbonyl group, a carboxylic acid group, or a halogenated alkyl group; the substituent represents a halogen atom, an alkyl group having from 1 to 6 carbon atoms, an alkoxy group having from 1 to 6 carbon atoms, a hydroxyl group, a cyano group, an amino group, a nitro group, or a halogenated alkyl group.

In the photoreceptor of the present invention, preferably, the photosensitive layer is the outermost surface layer, and also preferably, a surface protective layer is provided on the photosensitive layer, and the surface protective layer is the outermost surface layer. Further, in the photoreceptor of the present invention, preferably, the photosensitive layer is composed of a charge generation layer and a charge transport layer, and the charge transport layer is the outermost surface layer, also preferably, the photosensitive layer is a positively charged, single-layer type, and still also preferably, the photosensitive layer is composed of a charge transport layer and a charge generation layer, and the charge generation layer is the outermost surface layer.

Still further, in the photoreceptor of the present invention, preferably, the outermost surface layer contains the electron transport material in an amount of 10 parts by mass or less with respect to 100 parts by mass of the resin binder.

The method for manufacturing a photoreceptor of the present invention is a method for manufacturing a photoreceptor for electrophotography comprising applying a coating liquid on a conductive substrate to form an outermost surface layer, the coating liquid being comprised of a polyarylate resin having a structural unit represented by the Chemical Structural Formula 1 and a compound having a structure represented by the General Formula (ET2).

The electrophotographic device of the present invention has mounted therein the photoreceptor for electrophotography of the present invention.

The present invention can realize a photoreceptor for electrophotography with high sensitivity, low residual electric potential, no light fatigue, suppressed penetration of a component which leaks from a constituent member of a charging roller or a transfer roller into the surface of a photoreceptor, and improved stain resistance.

DETAILED DESCRIPTION OF THE INVENTION

Hereinafter, specific embodiments of the photoreceptor for electrophotography according to the present invention will be described in detail with reference to the drawings. The present invention is not limited at all by the following description.

Figure 1A:
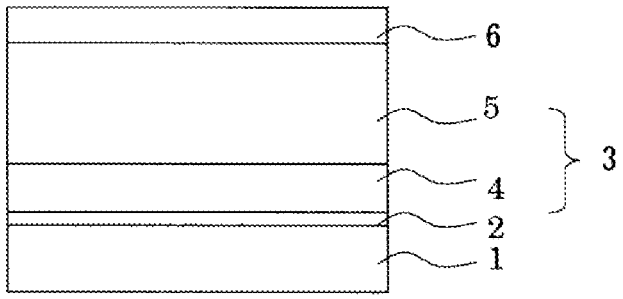
FIG. 1A is a schematic cross-sectional view illustrating one example of a negatively charged, functionally separated multi-layer photoreceptor for electrophotography according to the present invention.
Figure 1B:
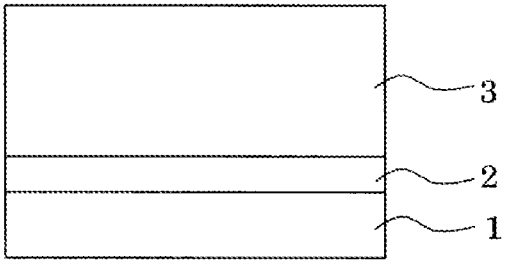
FIG. 1B is a schematic cross-sectional view illustrating one example of a positively charged, single-layer photoreceptor for electrophotography according to the present invention.
Figure 1C:
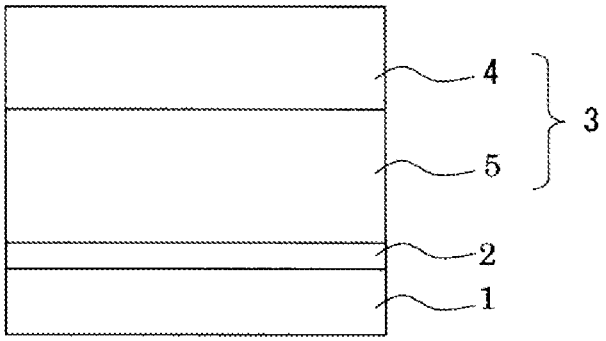
FIG. 1C is a schematic cross-sectional view illustrating an example of a positively charged, functionally separated multi-layer photoreceptor for electrophotography according to the present invention.

As mentioned above, photoreceptors for electrophotography are roughly classified into negatively charged multi-layer photoreceptors and positively charged multi-layer photoreceptors as functionally separated multi-layer photoreceptors and single-layer photoreceptors which are mainly positively charged type. FIG. 1A to FIG. 1C are schematic cross-sectional views illustrating photoreceptors for electrophotography according to examples of the present invention. FIG. 1A illustrates an example of a negatively charged, functionally separated multi-layer photoreceptor for electrophotography, FIG. 1B illustrates an example of a positively charged, single-layer photoreceptor for electrophotography, and FIG. 1C illustrates an example of a positively charged, functionally separated multi-layer photoreceptor for electrophotography.

As illustrated, the negatively charged multi-layer photoreceptor includes a conductive substrate 1, an undercoat layer 2 and a photosensitive layer 3 comprising a charge generation layer 4 having an electric charge generating function and a charge transport layer 5 having an electric charge transport function sequentially layered. The positively charged single-layer photoreceptor includes the conductive substrate 1, the undercoat layer 2, and a single photosensitive layer 3 having both a charge generating function and a charge transporting function sequentially layered. Further, in the positively charged multi-layer photoreceptor, on the conductive substrate 1, the undercoat layer 2 and a photosensitive layer 3 comprising a charge transport layer 5 having an electric charge transporting function and a charge generation layer 4 having an electric charge generating function are sequentially layered. In any type of photoreceptor, the undercoat layer 2 may be provided as needed, and a surface protective layer 6 may be further provided on the photosensitive layer 3. In the present invention, the term "photosensitive layer" is a concept including both a multi-layer photosensitive layer in which a charge generation layer and a charge transport layer are layered, and a single-layer photosensitive layer.

In the present invention, it is important to use a combination of a polyarylate resin and a specific electron transport material for any of the photosensitive layer, the surface protective layer, and the like constituting the outermost surface layer of the photoreceptor. Specifically, in the case of a photoreceptor having a configuration in which the outermost surface layer is a photosensitive layer, a desired effect of the present invention can be obtained by including the polyarylate resin and the specific electron transport material in the photosensitive layer. In this case, when the photosensitive layer is a negatively charged multi-layer photoreceptor composed of a charge generation layer and a charge transport layer, and the outermost surface layer is a charge transport layer, by containing a polyarylate resin and a specific electron transport material in the charge transport layer, a desired effect of the present invention can be obtained. In the case of a positively charged single-layer photoreceptor in which the photosensitive layer is positively charged single-layer type, by including a polyarylate resin and a specific electron transport material in the single-layer photosensitive layer, a desired effect of the present invention can be obtained. Further, when the photosensitive layer is a positively charged multi-layer photoreceptor composed of a charge transport layer and a charge generation layer, and the outermost surface layer is a charge generation layer, by including a polyarylate resin and a specific electron transport material in the charge generation layer, a desired effect of the present invention can be obtained. On the other hand, in the case of using a photoreceptor comprising a surface protective layer on a photosensitive layer and having a configuration in which the surface protective layer is the outermost surface layer, by including a polyarylate resin and a specific electron transport material in the surface protective layer, a desired effect of the present invention can be obtained.

In any of the above-described types of photoreceptors, the addition amount of the specific electron transport material in the outermost surface layer is preferably 10 parts by mass or less with respect to 100 parts by mass of the resin binder contained in the layer, more preferably in the range of from 1 to 10 parts by mass, and particularly preferably in the range of from 3 to 5 parts by mass. When the amount of the above-described compound used exceeds 10 parts by mass, precipitation occurs, which is not preferable.

The conductive substrate 1 serves as an electrode of the photoreceptor and at the same time serves as a support for each layer constituting the photoreceptor, and may be in any shape such as a cylindrical shape, a plate shape, or a film shape. As a material of the conductive substrate 1, metals such as aluminum, stainless steel, or nickel, or conductivity-treated glass or resin, or the like can be used.

An undercoat layer 2 is composed of a layer containing a resin as a main component or a metal oxide film such as alumite. In order to control the injectability of electric charges from the conductive substrate 1 to the photosensitive layer or for the purpose of coating defects on the surface of the conductive substrate and improving adhesion between the photosensitive layer and the conductive substrate 1, the undercoat layer 2 is provided as needed. Examples of the resin material used for the undercoat layer 2 include insulating polymers such as casein, polyvinyl alcohol, polyamide, melamine, and cellulose, and conductive polymers such as polythiophene, polypyrrole, and polyaniline, and these resins can be used singly or in combination as appropriate. A metal oxide such as titanium dioxide or zinc oxide may be contained in these resins.

Negatively Charged Multi-Layer Photoreceptor:

In the negatively charged multi-layer photoreceptor, a charge generation layer 4 is formed by a method such as coating a coating liquid in which particles of an electric charge generating material are dispersed in a resin binder, and generates electric charges by receiving light. It is important that the electric charge generation efficiency is high and at the same time the charge generated is injected into the charge transport layer 5, and it is desirable that the electric field dependency is small and injection is favorable even in a low electric field.

As the electric charge generating material, phthalocyanine compounds such as X-type non-metal phthalocyanine, τ-type non-metal phthalocyanine, α-type titanyl phthalocyanine, β-type titanyl phthalocyanine, Y-type titanyl phthalocyanine, γ-type titanyl phthalocyanine, amorphous type titanyl phthalocyanine, ε-type copper phthalocyanine, a variety of azo pigments, anthanthrone pigments, thiapyrylium pigments, perylene pigments, perinone pigments, squarylium pigments, quinacridone pigments or the like can be used singly or in appropriate combination, and a suitable substance can be selected according to the light wavelength region of an exposure light source used for image formation. As the resin binder, polymers, copolymers, and the like of polycarbonate resins, polyester resins, polyamide resins, polyurethane resins, vinyl chloride resins, vinyl acetate resins, phenoxy resins, polyvinyl acetal resins, polyvinyl butyral resins, polystyrene resins, polysulfone resins, diallyl phthalate resins, and methacrylic acid ester resins can be appropriately combined and used.

The content of the resin binder in the charge generation layer 4 is preferably from 20 to 80% by mass, more preferably from 30 to 70% by mass, based on the solid content of the charge generation layer 4. The content of the electric charge generating material in the charge generation layer 4 is preferably from 20 to 80% by mass, more preferably from 30 to 70% by mass, based on the solid content in the charge generation layer 4.

Since the charge generation layer 4 only has to have a charge generating function, its film thickness is determined by the light absorption coefficient of the electric charge generating material, and is generally 1 μm or less, and preferably 0.5 μm or less. The charge generation layer 4 is mainly composed of an electric charge generating material and can be used by adding an electric charge transport material or the like thereto.

The charge transport layer 5 is mainly composed of an electric charge transport material and a resin binder. In the present invention, when the charge transport layer 5 is the outermost surface layer, a polyarylate resin having the structural unit represented by the chemical structural formula 1 is needed to be used as a resin binder of the charge transport layer 5.

In the photoreceptor of the present invention, such a polyarylate resin may have another structural unit. When the total amount of the polyarylate resin is 100 mol %, the compounding ratio of the structural unit represented by the chemical structural formula 1 is preferably from 10 to 100 mol %, more preferably 50 to 100 mol %.

In the photoreceptor of the present invention, when the total amount ($a_1+a_2+b_1+b_2+c+d+e+f$) of the structural unit represented by the chemical structural formula 1 is 100 mol %, ($c+d+e+f$) is from 0 to 10 mol % as the amount of the siloxane component. Further, in the photoreceptor of the present invention, preferably, c and d in the chemical structural formula 1 are 0 mol %, or preferably, e and f are 0 mol %.

Furthermore, s and t in the chemical structural formula 1 are integers of from 1 to 400, preferably from 1 to 400, and more preferably from 8 to 250.

In the photoreceptor of the present invention, in order to obtain a desired effect, in the above chemical structural formula 1, preferably, $W_2$ is a single bond, —O—, or —$CR_{22}R_{23}$—, where $R_{22}$ and $R_{23}$ may be the same or different, and are a hydrogen atom, a methyl group, or an ethyl group, and preferably, $W_1$ is —$CR_{22}R_{23}$—, where $R_{22}$ and $R_{23}$ may be the same or different, and are a hydrogen atom, a methyl group, or an ethyl group). More preferably, $W_1$ is a methylene group, $W_2$ is a single bond, $R_1$ and $R_6$ are each a methyl group, and $R_2$ to $R_5$ and $R_7$ to $R_{20}$ are hydrogen atoms.

Further, examples of the siloxane structure of the polyarylate resin of the above chemical structural formula 1 include constituent monomers such as the following molecular formula (2) (manufactured by Chisso Corporation; Reactive Silicone SilaplaneFM4411 (weight average molecular weight 1000), FM4421 (weight average molecular weight 5000), FM4425 (weight average molecular weight 15000)) or the following molecular formula (3) (manufactured by Chisso Corporation; Reactive Silicone Silaphane FMDA 11 (weight average molecular weight 1000), FMDA 21 (weight average molecular weight 5000), FMDA 26 (weight average molecular weight 15,000)).

Molecular Formula (2):

| Structural formula number | Basic structure | Average molecular weight | Structure example |
|---|---|---|---|
| Formula (2)-1 | 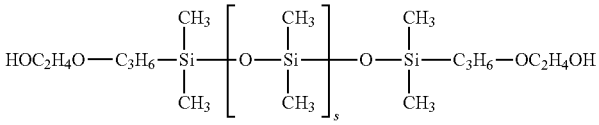 | 1000 | manufactured by Chrisso Corporation Silaplane FM-4411 |
| Formula (2)-2 | | 5000 | manufactured by Chisso Corporation Silaplane FM-4421 |
| Formula (2)-3 | | 10000 | manufactured by Chisso Corporation Silaplane FM-4425 |

Molecular Formula (3):

| Structural formula number | Basic structure* | Average molecular weight | Structure example |
|---|---|---|---|
| Formula (3)-1 | 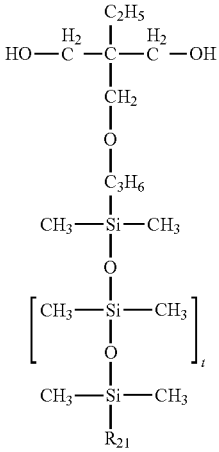 | 1000 | manufactured by Chisso Corporation Silaplane FM-DA11 |
| Formula (3)-2 | | 5000 | manufactured by Chisso Corporation Silaplane FM-DA21 |
| Formula (3)-3 | | 15000 | manufactured by Chisso Corporation Silaplane FM-DA26 |

*In the formula, $R_{21}$ represents an n-butyl group.

The polyarylate resin represented by the chemical structural formula 1 may be used singly or in combination with other resins. As such other resins, other polyarylate resins, a variety of polycarbonate resins such as bisphenol A type, bisphenol Z type, or bisphenol A type-biphenyl copolymer, bisphenol Z type-biphenyl copolymer, polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resins, silicone resins, polyamide resins, polystyrene resins, polyacetal resins, polysulfone resins, a polymer of a methacrylic acid ester, a copolymer thereof, or the like can be used. Further, the same kind of resins having different molecular weights may be mixed and used.

The content of the resin binder is preferably from 10 to 90% by mass, more preferably from 20 to 80% by mass, based on the solid content of the charge transport layer 5. The content of the polyarylate resin with respect to the resin binder is preferably in the range of from 1% by mass to 100% by mass, and more preferably in the range of from 5% by mass to 80% by mass.

The weight average molecular weight of these polyarylate resins is preferably from 5,000 to 250,000, and more preferably from 10,000 to 150,000.

In the following, specific examples of the structural formulae ($A_1$), ($A_2$), ($B_1$), ($B_2$), (C), (D), (E), and (F) which are structural units represented by the chemical structural formula 1 are described below. Specific examples of polyarylate resins having the structural formulae ($A_1$), ($A_2$), ($B_1$), ($B_2$), (C), (D), (E) and (F) are listed in Table 1 below. It is noted that the polyarylate resin according to the present invention is not limited to these illustrated structures.

Specific examples of the structural formula ($A_1$):

$A_{10}$

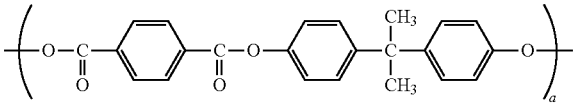

$A_{11}$

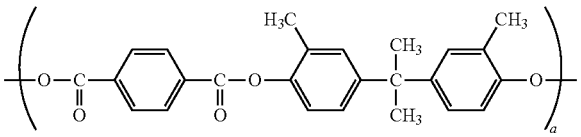

$A_{12}$

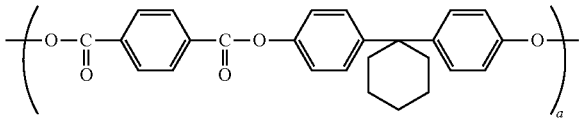

$A_{13}$

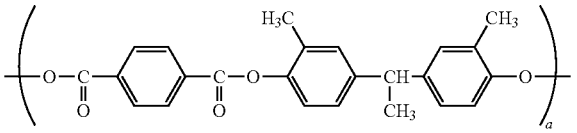

$A_{14}$

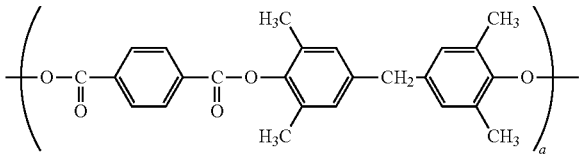

-continued $A_{15}$

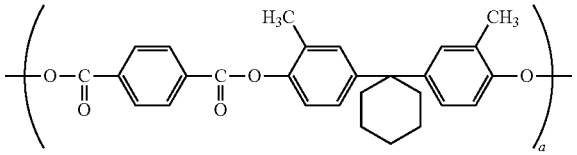

$A_{16}$

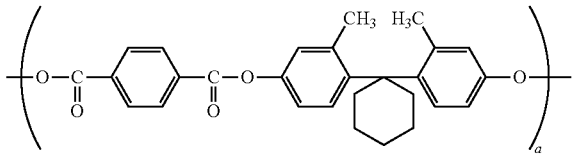

$A_{17}$

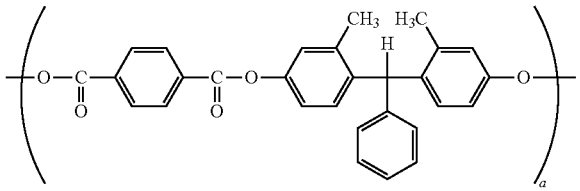

$A_{18}$

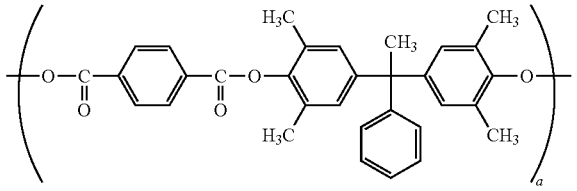

$A_{19}$

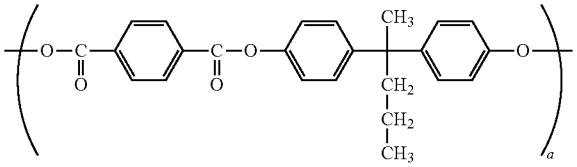

Specific examples of the structural formula ($A_2$):

$A_{20}$

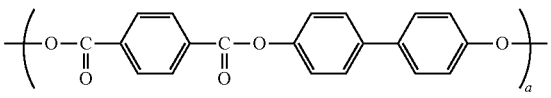

$A_{21}$

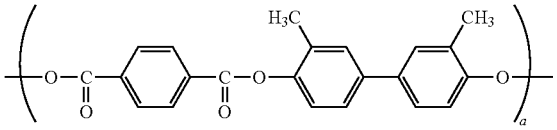

$A_{22}$

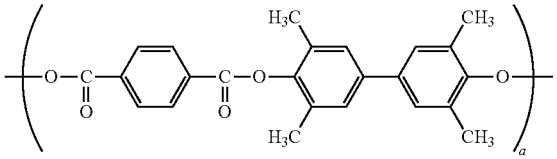

-continued
$A_{23}$
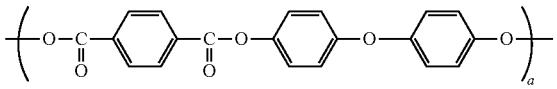
$A_{24}$
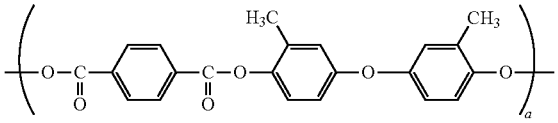
$A_{25}$
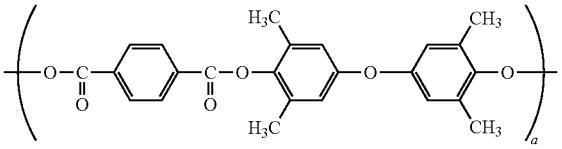
$A_{26}$
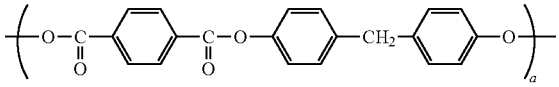
$A_{27}$
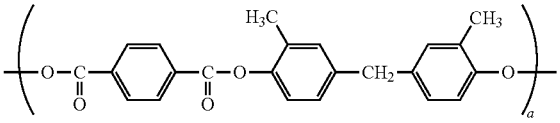
$A_{28}$
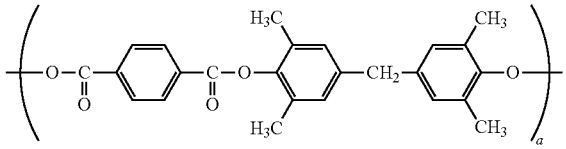
$A_{29}$
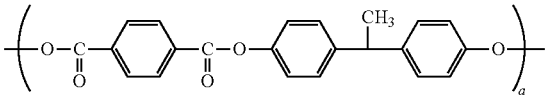
Specific examples of the structural formula ($B_1$):
$B_{10}$
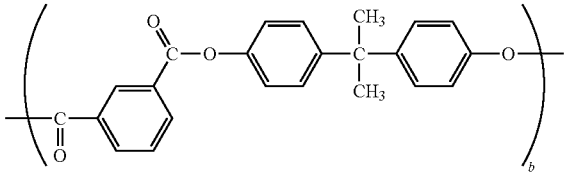
$B_{11}$
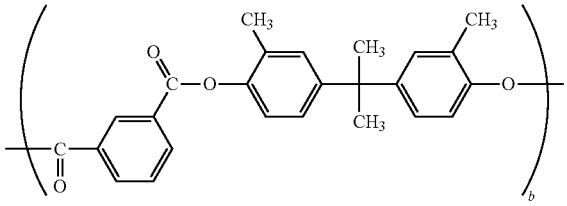
-continued
$B_{12}$
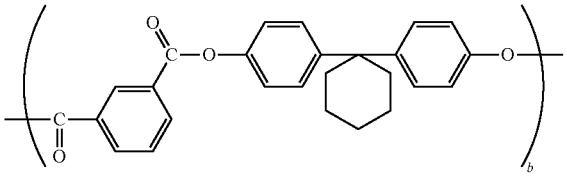
$B_{13}$
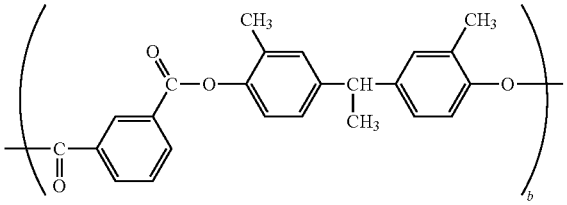
$B_{14}$
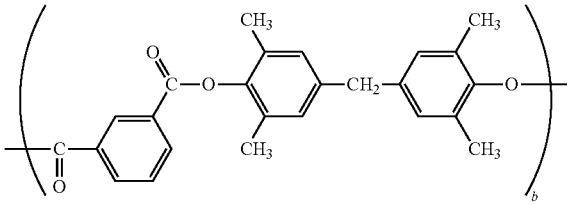
$B_{15}$
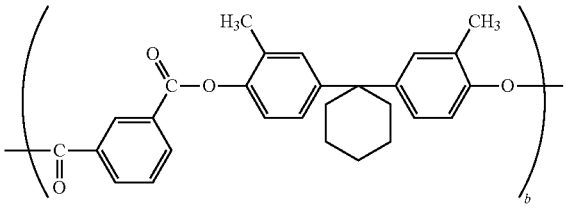
$B_{16}$
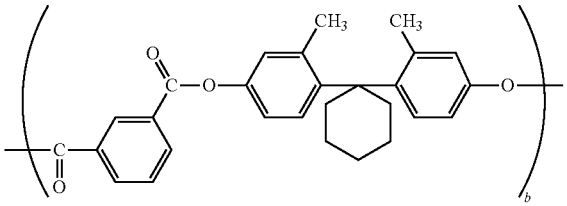
$B_{17}$
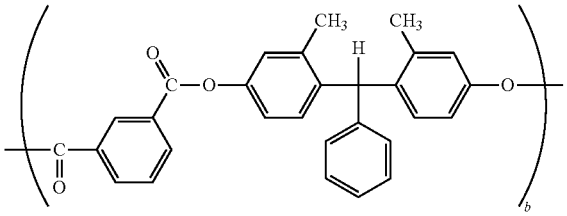

-continued
$B_{18}$
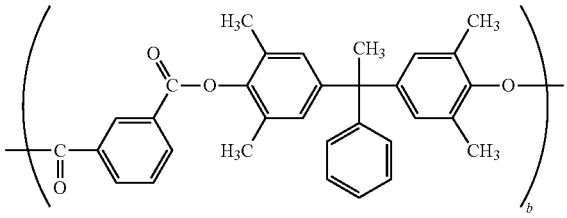
$B_{19}$
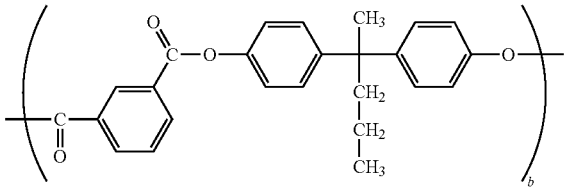
Specific examples of the structural formula ($B_2$):
$B_{20}$
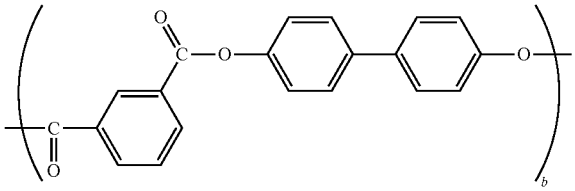
$B_{21}$
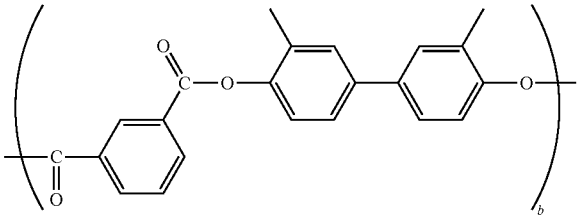
$B_{22}$
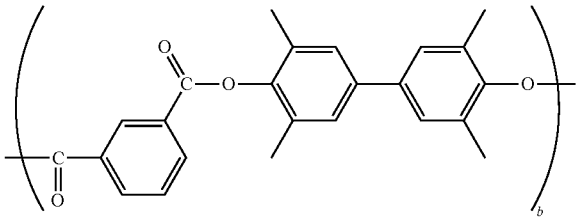
$B_{23}$
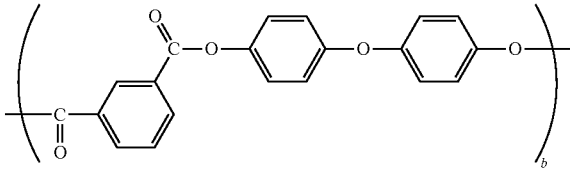
-continued
B24
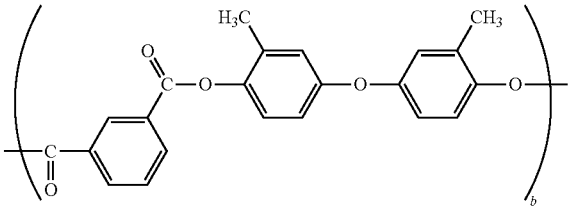
$B_{25}$
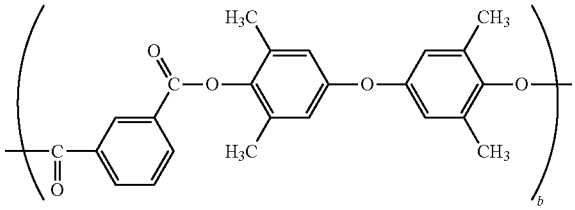
$B_{26}$
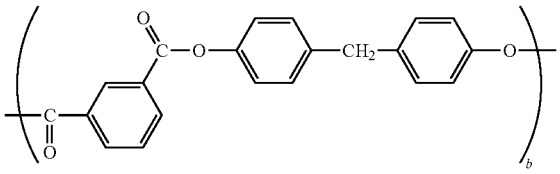
$B_{27}$
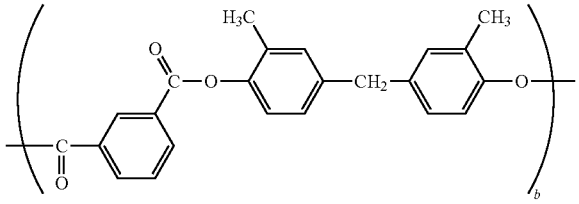
$B_{28}$
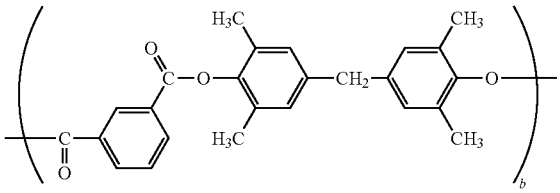
$B_{29}$
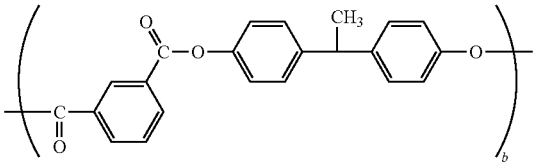

A specific example of the structural formula (C):

C1

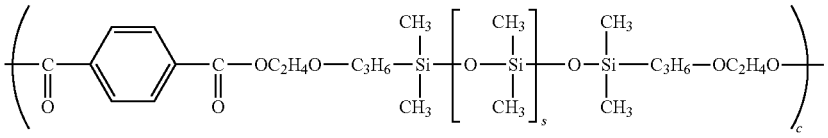

A specific example of the structural formula (D):

D1

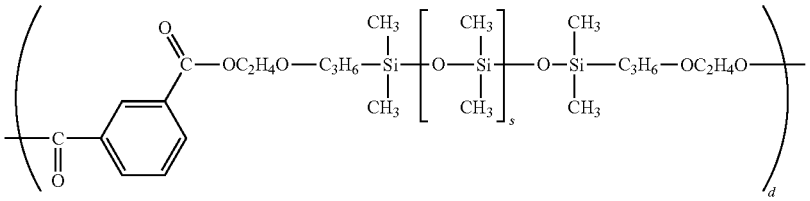

A specific example of the structural formula (E):

E1

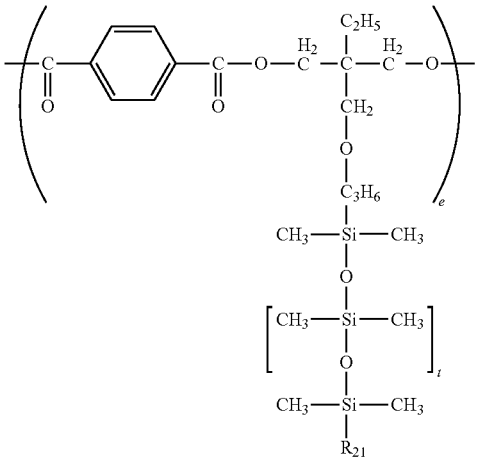

A specific example of the structural formula (F):

F1

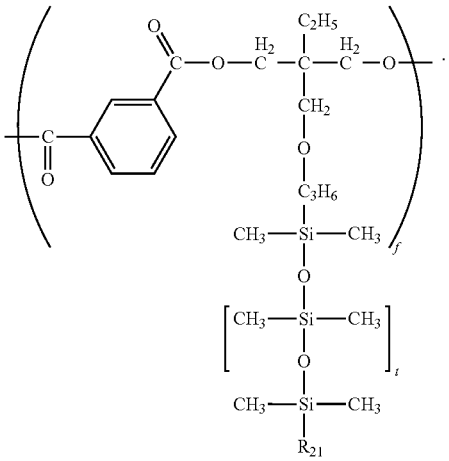

where, in the formula, $R_{21}$ represents an n-butyl group.

TABLE 1

| Structure | Structural monomer type | | | | | | | |
|---|---|---|---|---|---|---|---|---|
| No. | A1 | A2 | B1 | B2 | C | D | E | F |
| I-1 | A10 | | | | | | | |
| I-2 | | | B10 | | | | | |
| I-3 | A10 | A20 | B10 | B20 | C1 | D1 | | |
| I-4 | A11 | A21 | B11 | B21 | C1 | D1 | | |
| I-5 | A12 | A22 | B12 | B22 | C1 | D1 | | |
| I-6 | A13 | A23 | B13 | B23 | C1 | D1 | | |
| I-7 | A14 | A24 | B14 | B24 | C1 | D1 | | |
| I-8 | A15 | A25 | B15 | B25 | C1 | D1 | | |
| I-9 | A16 | A26 | B16 | B26 | C1 | D1 | | |
| I-10 | A17 | A27 | B17 | B27 | C1 | D1 | | |
| I-11 | A18 | A28 | B18 | B28 | C1 | D1 | | |
| I-12 | A19 | A29 | B19 | B29 | C1 | D1 | | |
| I-13 | A10 | A20 | B10 | B20 | | | E1 | F1 |
| I-14 | A11 | A21 | B11 | B21 | | | E1 | F1 |
| I-15 | A12 | A22 | B12 | B22 | | | E1 | F1 |
| I-16 | A13 | A23 | B13 | B23 | | | E1 | F1 |
| I-17 | A14 | A24 | B14 | B24 | | | E1 | F1 |
| I-18 | A15 | A25 | B15 | B25 | | | E1 | F1 |
| I-19 | A16 | A26 | B16 | B26 | | | E1 | F1 |
| I-20 | A17 | A27 | B17 | B27 | | | E1 | F1 |
| I-21 | A18 | A28 | B18 | B28 | | | E1 | F1 |
| I-22 | A19 | A29 | B19 | B29 | | | E1 | F1 |
| I-23 | A10 | A20 | B10 | B20 | C1 | D1 | E1 | F1 |
| I-24 | A11 | A21 | B11 | B21 | C1 | D1 | E1 | F1 |
| I-25 | A12 | A22 | B12 | B22 | C1 | D1 | E1 | F1 |
| I-26 | A13 | A23 | B13 | B23 | C1 | D1 | E1 | F1 |
| I-27 | A14 | A24 | B14 | B24 | C1 | D1 | E1 | F1 |
| I-28 | A15 | A25 | B15 | B25 | C1 | D1 | E1 | F1 |
| I-29 | A16 | A26 | B16 | B26 | C1 | D1 | E1 | F1 |
| I-30 | A17 | A27 | B17 | B27 | C1 | D1 | E1 | F1 |
| I-31 | A18 | A28 | B18 | B28 | C1 | D1 | E1 | F1 |
| I-32 | A19 | A29 | B19 | B29 | C1 | D1 | E1 | F1 |

When the charge transport layer 5 is the outermost surface layer, it is needed for the electron transport material constituting the charge transport layer to contain a compound having the structure represented by the above general formula (ET2). Among these, when an electron transport material having an electron-withdrawing substituent such as a chloro group (—Cl) is used, compared to unsubstituted material, a HOMO/LUMO gets deeper, the electron acceptability improves, the mobility becomes faster, the electron transport capability becomes higher, and, in a photoreceptor using such a material, the resistance to light fatigue improves, which is preferable. Preferably, the electron transport material constituting the charge transport layer further contains one or both of the compounds having the structure represented by the above general formula (ET1) or (ET3), and in addition, one or a combination of two or more electron transport materials (acceptor compounds) such as succinic anhydride, maleic anhydride, dibromosuccinic anhydride, phthalic anhydride, 3-nitro phthalic anhydride, 4-nitro phthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, a thiopyran compound, a quinone compound, a benzoquinone compound, a diphenoquinone compound, a naphthoquinone compound, an azoquinone compound, an anthraquinone compound, a diiminoquinone compound, or a stilbenequinone compound can be used.

Specific examples of the compound represented by general formula (ET1) used in the present invention include, but are not limited to, the following compounds.

(ET1-1)

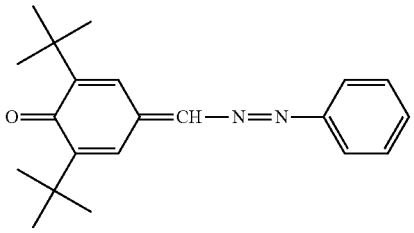

(ET1-2)

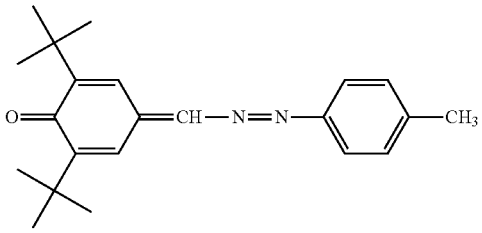

(ET1-3)

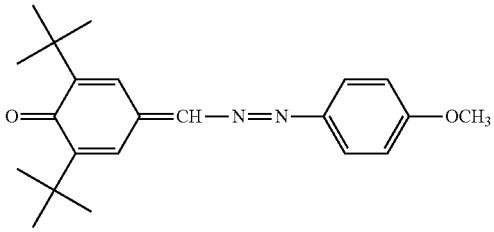

(ET1-4)

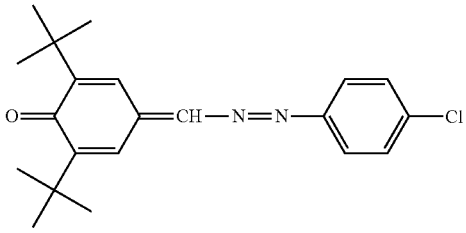

-continued (ET1-5)

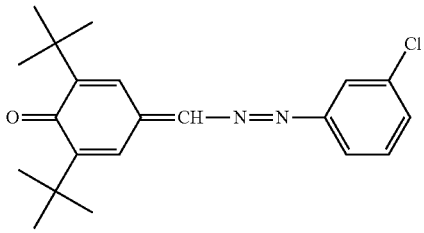

(ET1-6)

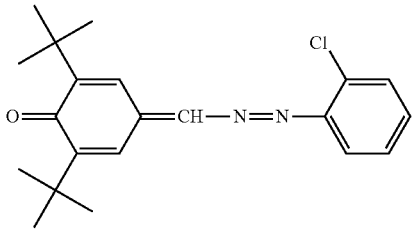

(ET1-7)

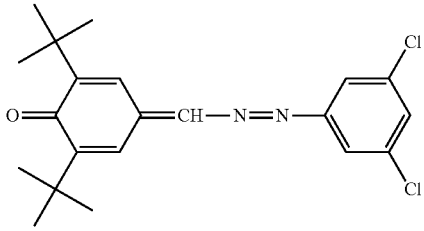

(ET1-8)

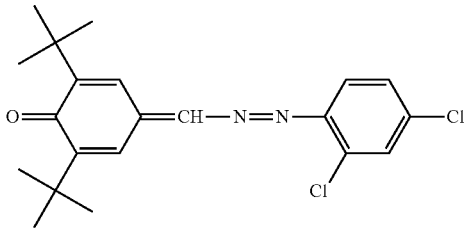

(ET1-9)

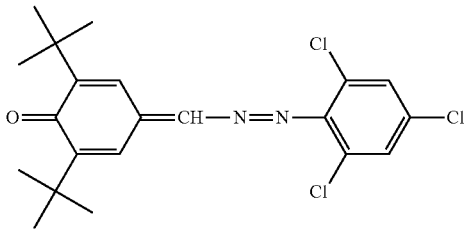

(ET1-10)

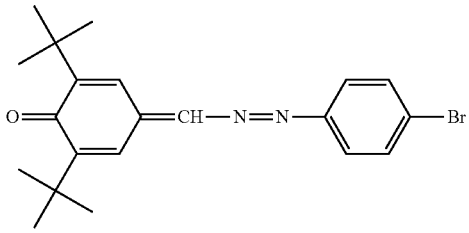

-continued
(ET1-11)
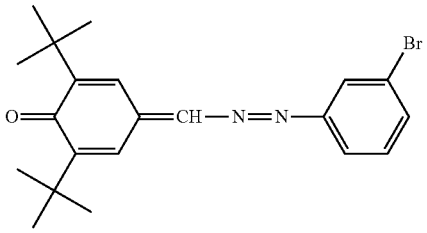
(ET1-12)
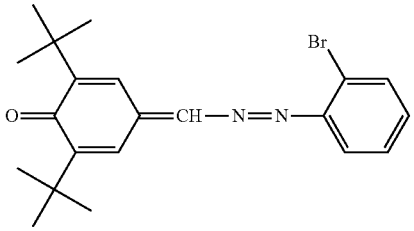
(ET1-13)
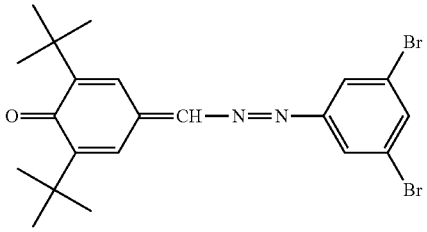
(ET1-14)
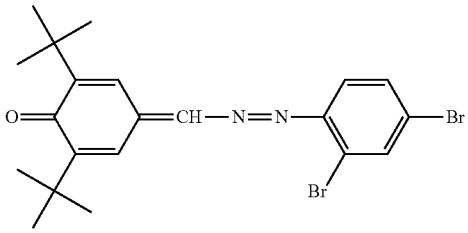
(ET1-15)
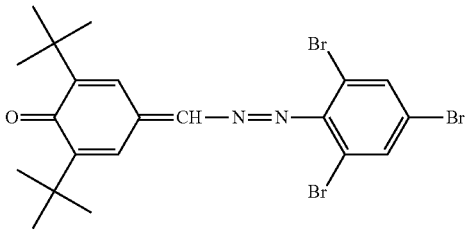
(ET1-16)
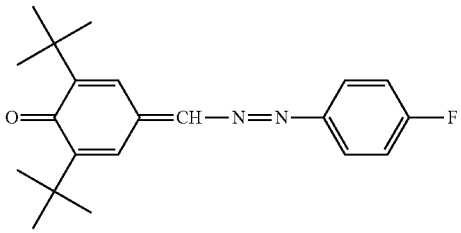
-continued
(ET1-17)
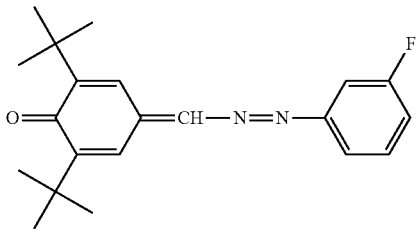
(ET1-18)
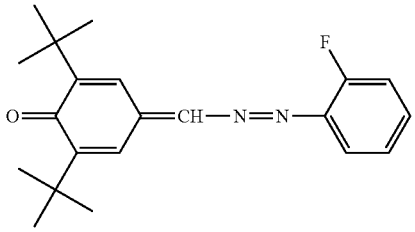
(ET-1-19)
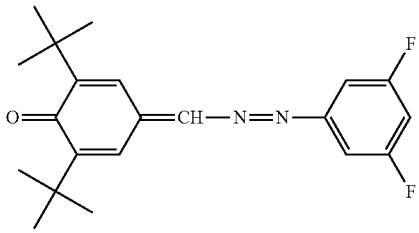
(ET-1-20)
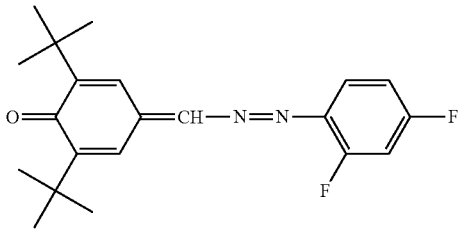
(ET1-21)
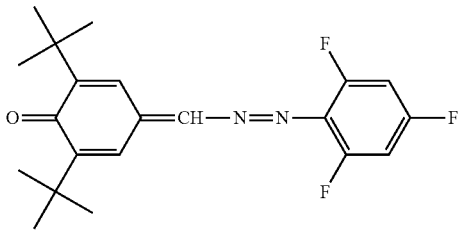
(ET1-22)
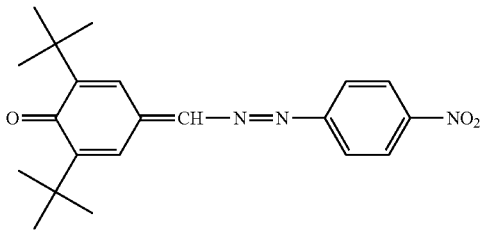

-continued
(ET1-23)
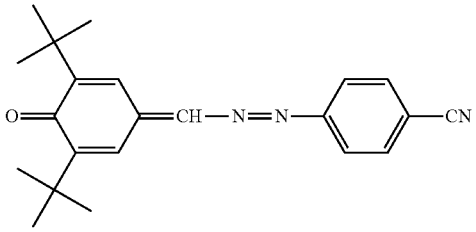
(ET1-24)
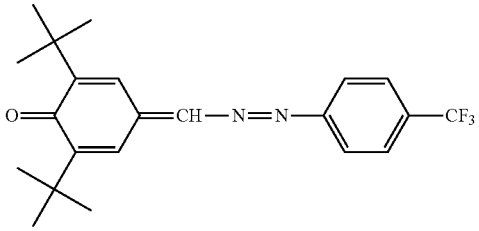
(ET1-25)
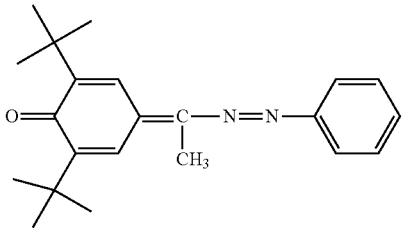
(ET1-26)
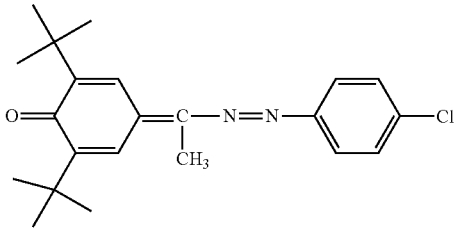
(ET1-27)
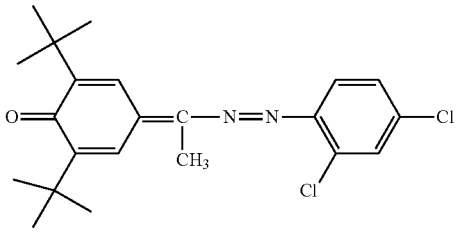
(ET1-28)
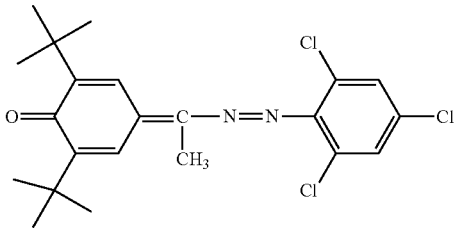
-continued
(ET1-29)
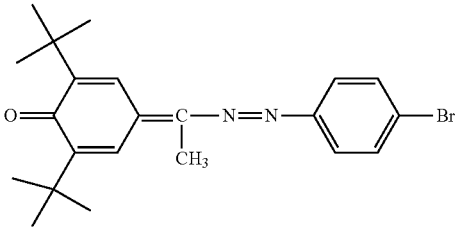
(ET1-30)
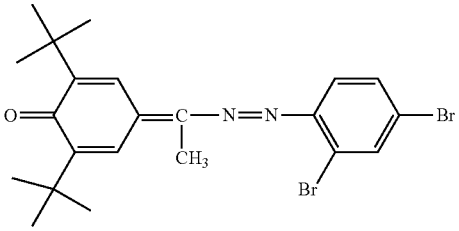
(ET1-31)
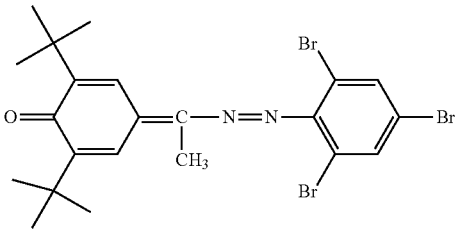
(ET1-32)
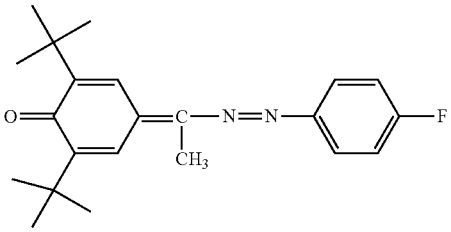
(ET1-33)
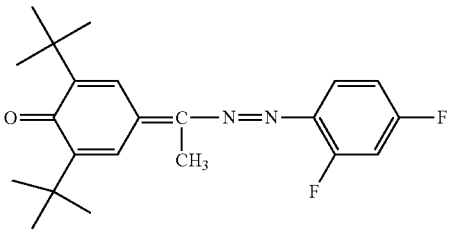
(ET1-34)
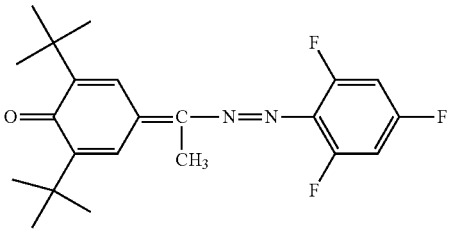

-continued
(ET1-35)
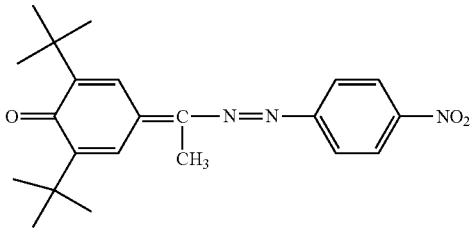
(ET1-36)
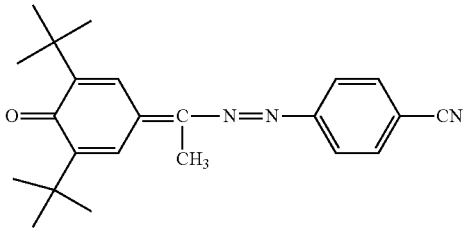
(ET1-37)
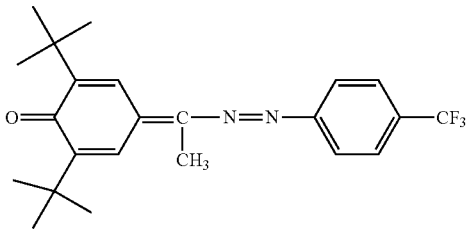
(ET1-38)
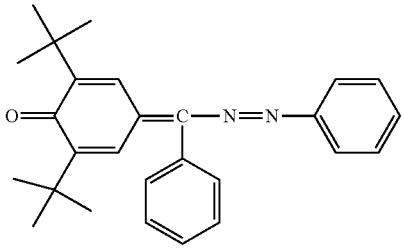
(ET1-39)
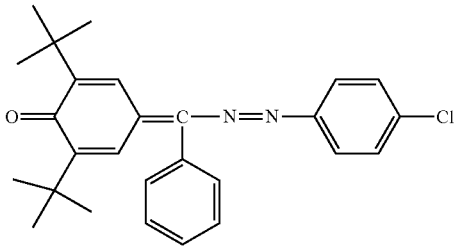
(ET1-40)
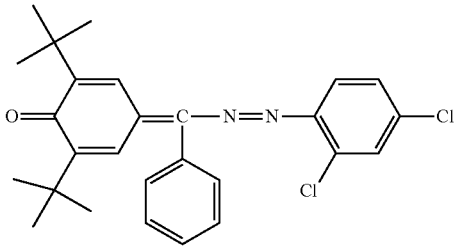
-continued
(ET1-41)
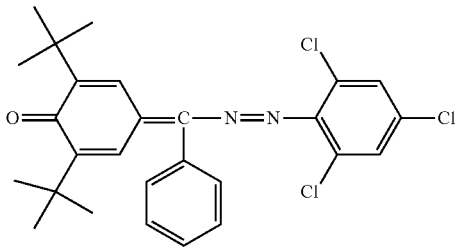
(ET1-42)
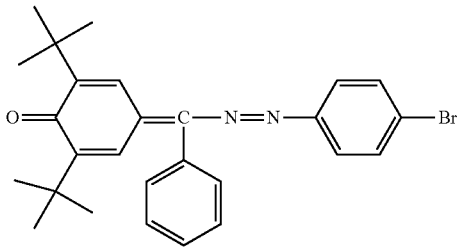
(ET1-43)
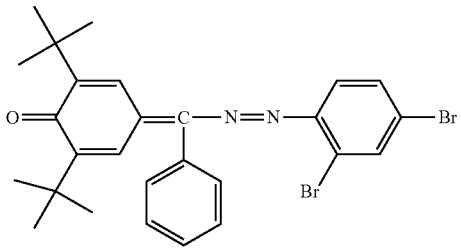
(ET1-44)
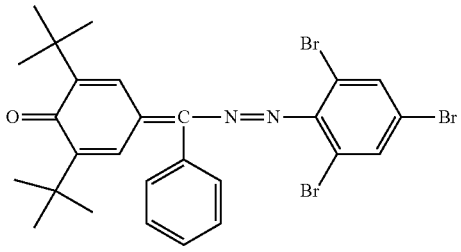
(ET1-45)
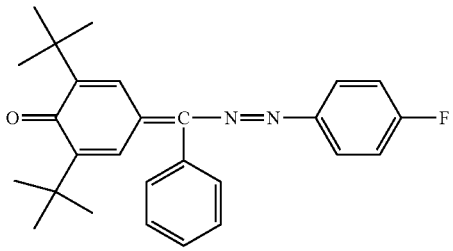

-continued
(ET1-46)
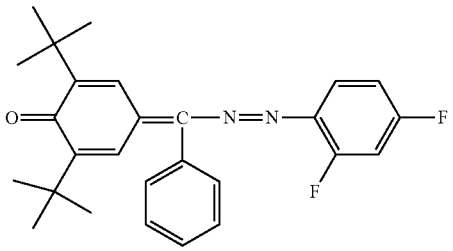
(ET1-47)
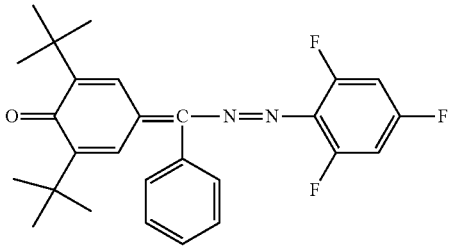
(ET1-48)
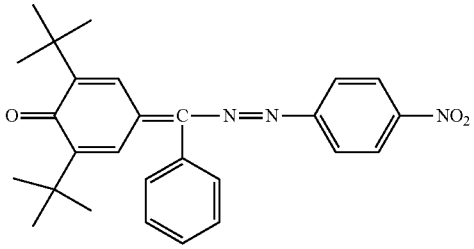
(ET1-49)
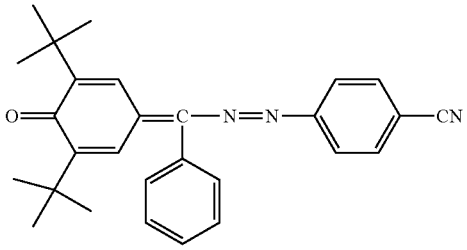
(ET1-50)
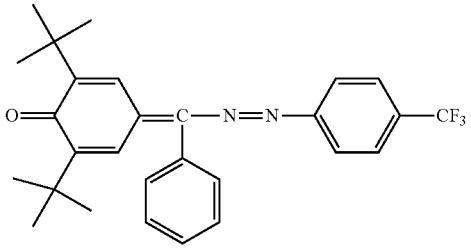
-continued
(ET1-51)
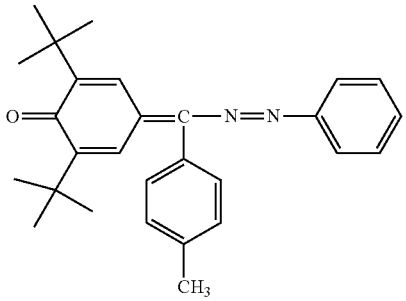
(ET1-52)
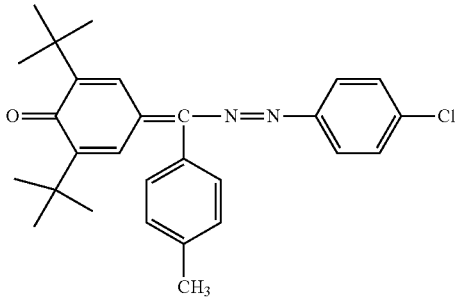
(ET1-53)
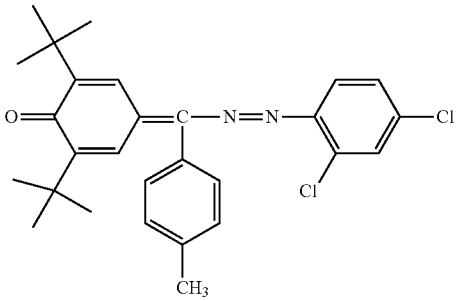
(ET1-54)
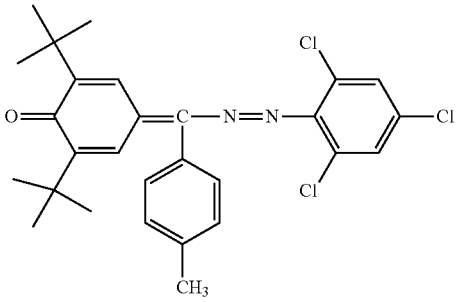
(ET1-55)
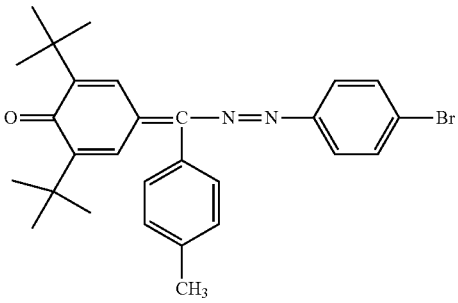

-continued
(ET1-56)
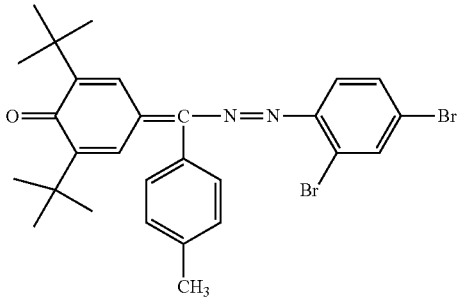
(ET1-57)
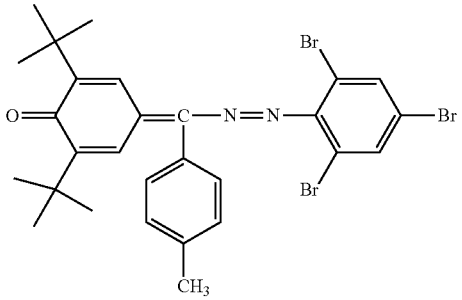
(ET1-58)
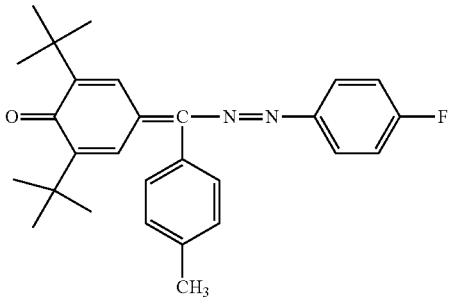
(ET1-59)
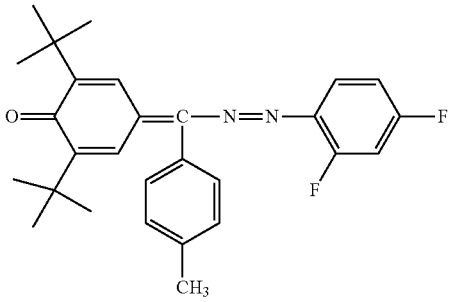
(ET1-60)
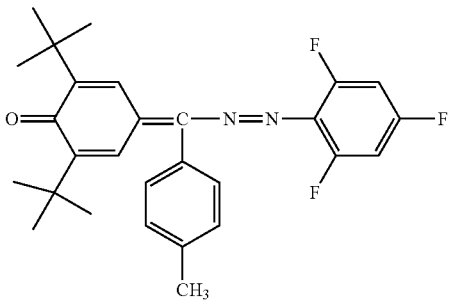
-continued
(ET1-61)
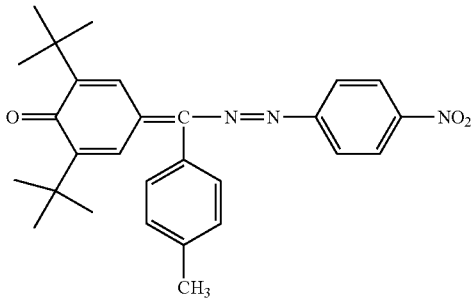
(ET1-62)
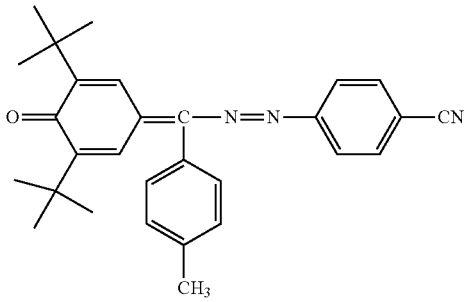
(ET1-63)
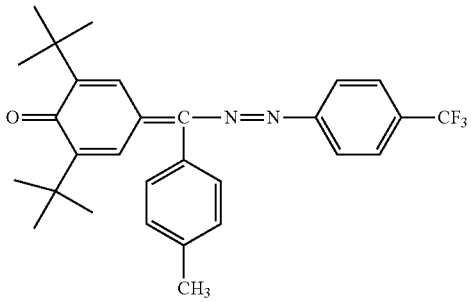
(ET1-64)
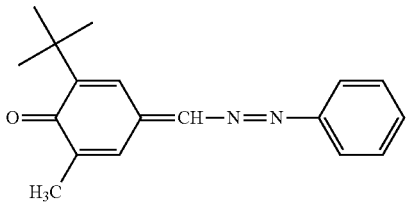
(ET1-65)
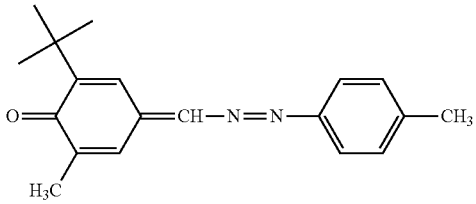

-continued
(ET1-66)
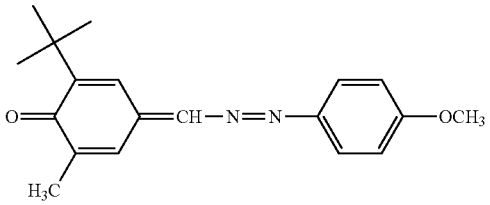
(ET1-67)
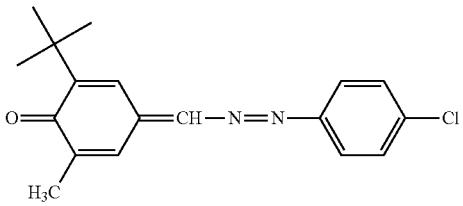
(ET1-68)
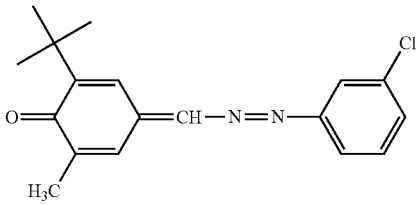
(ET1-69)
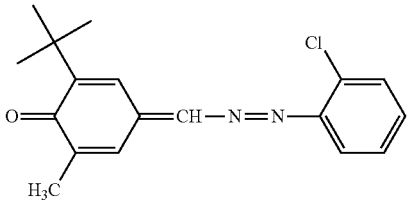
(ET1-70)
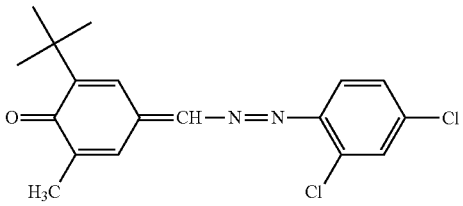
(ET1-71)
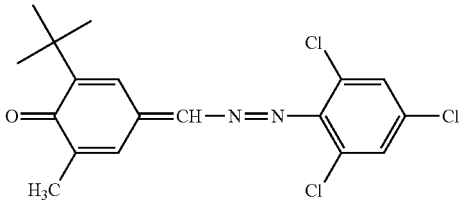
(ET1-72)
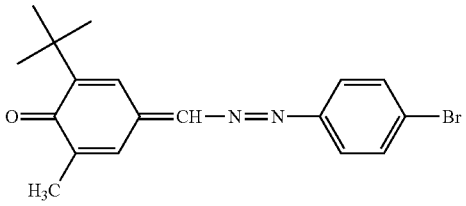
-continued
(ET1-73)
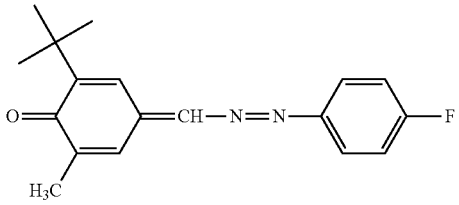
(ET1-74)
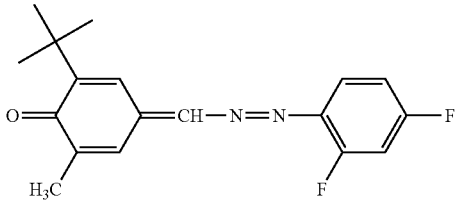
(ET1-75)
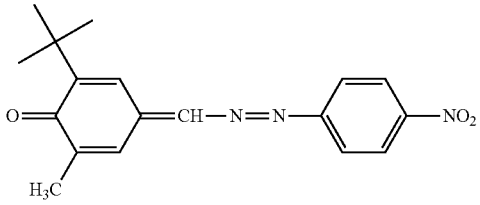
(ET1-76)
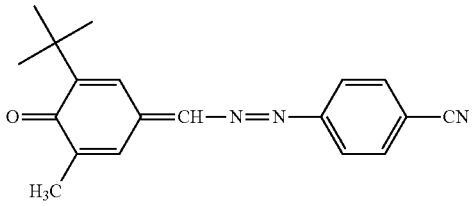
(ET5-77)
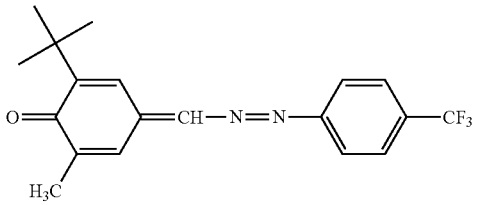
Specific examples of the compound represented by the general formula (ET2) used in the present invention include, but are not limited to, the following compounds.
(ET2-1)
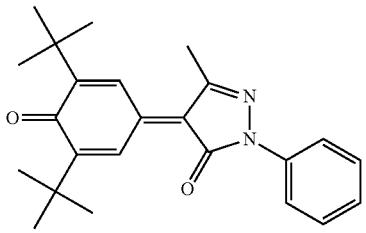

-continued
(ET2-2)
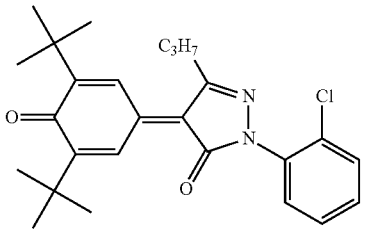
(ET2-3)
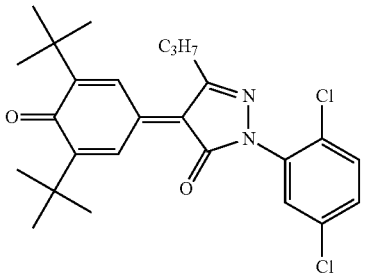
(ET2-4)
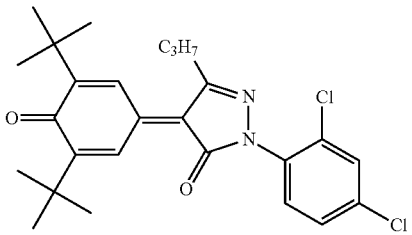
(ET2-5)
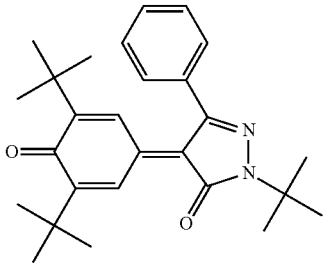
(ET2-6)
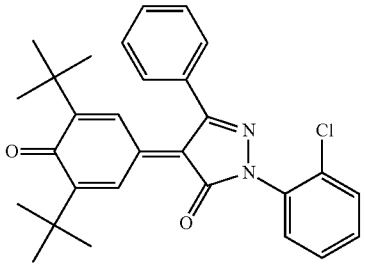
(ET2-7)
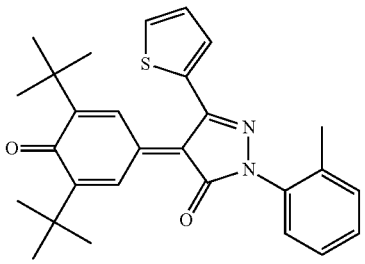
-continued
(ET2-8)
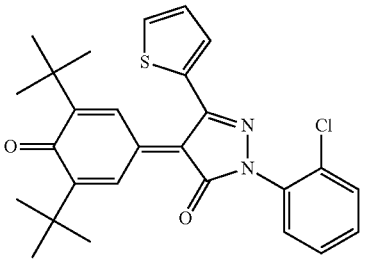
(ET2-9)
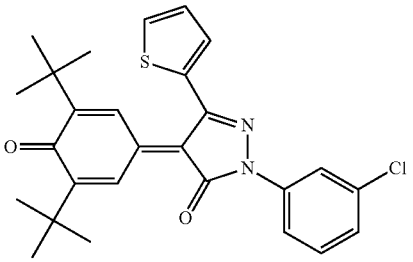
(ET2-10)
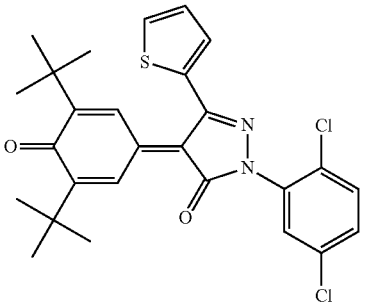
(ET2-11)
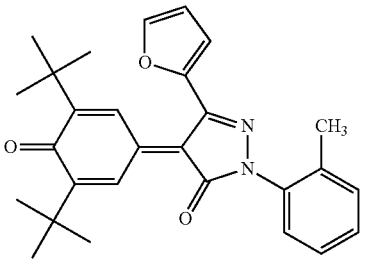
(ET2-12)
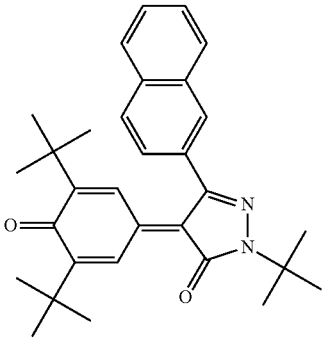

-continued
(ET2-13)
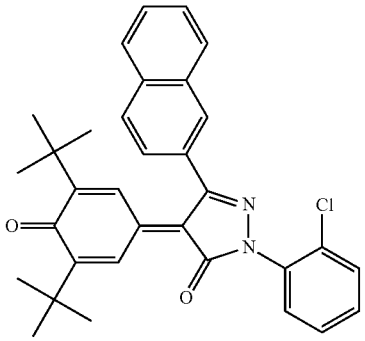
Specific examples of the compound represented by the general formula (ET3) used in the present invention include, but are not limited to, the following compounds.
(ET3-1)
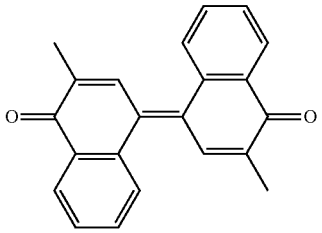
(ET3-2)
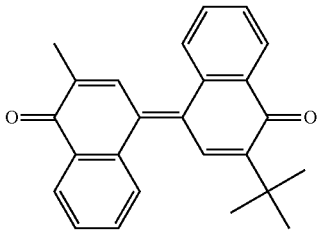
(ET3-3)
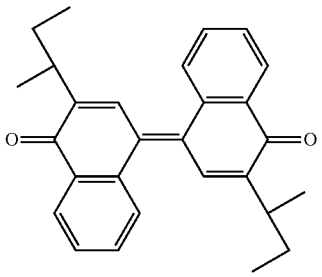
(ET3-4)
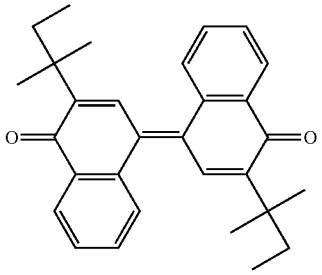
-continued
(ET3-5)
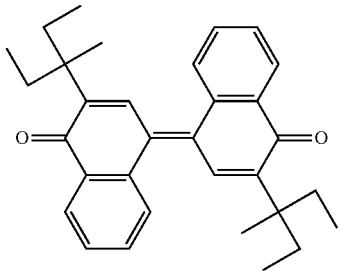
(ET3-6)
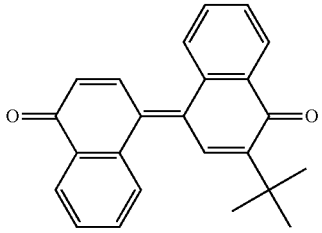
(ET3-7)
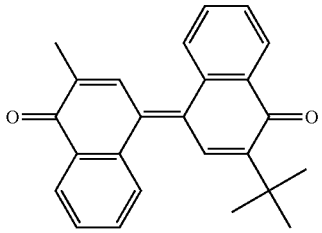
(ET3-8)
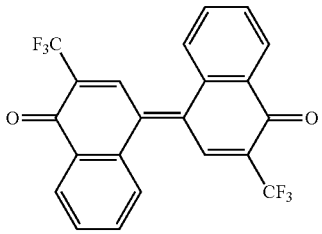
(ET3-9)
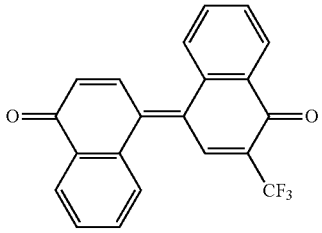
(ET3-10)
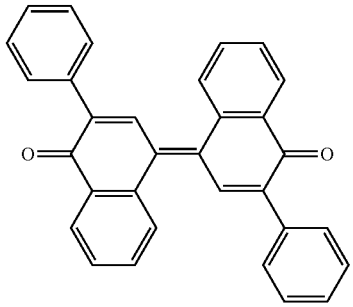

-continued (ET3-11)

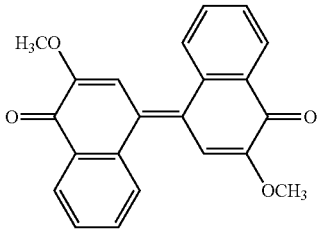

(ET3-12)

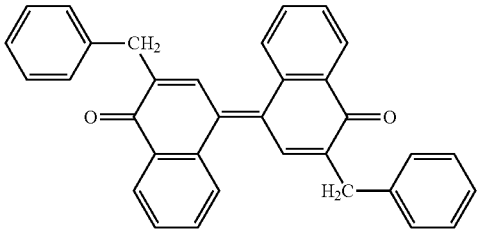

(ET3-13)

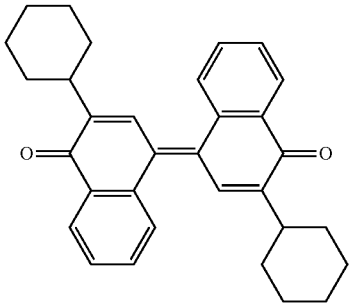

As the electric charge transport material of the charge transport layer 5, a variety of hydrazone compounds, styryl compounds, diamine compounds, butadiene compounds, indole compounds, and the like can be used singly or in combination as appropriate. Examples of such an electric charge transport material include, but are not limited to, those represented by the following (II-1) to (II-14).

II-1

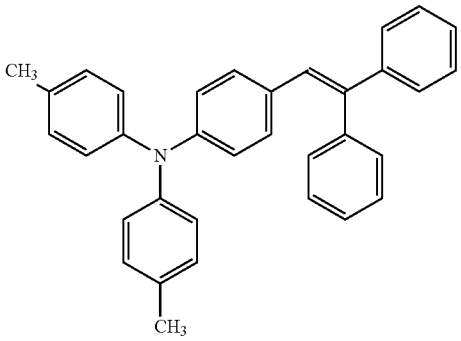

-continued

II-2

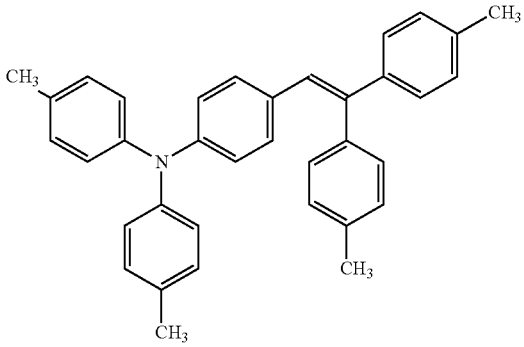

II-3

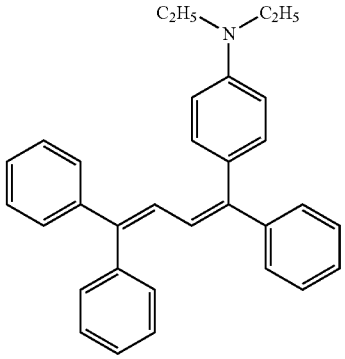

II-4

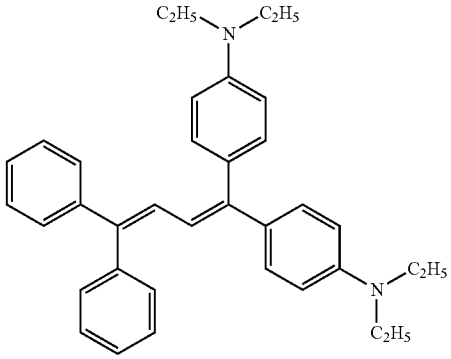

II-5

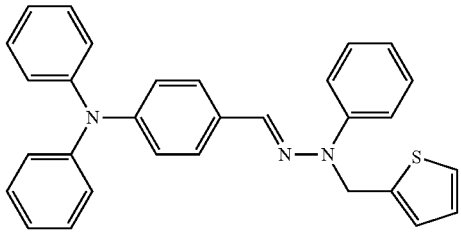

-continued
II-6
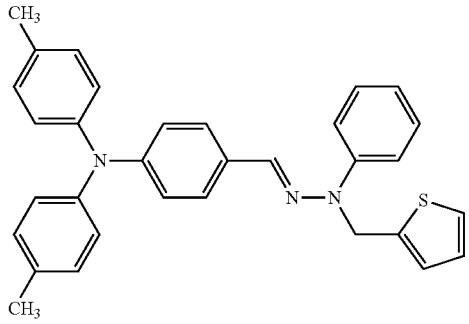
II-7
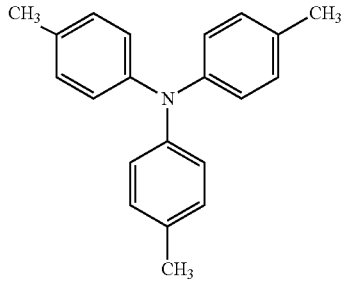
II-8
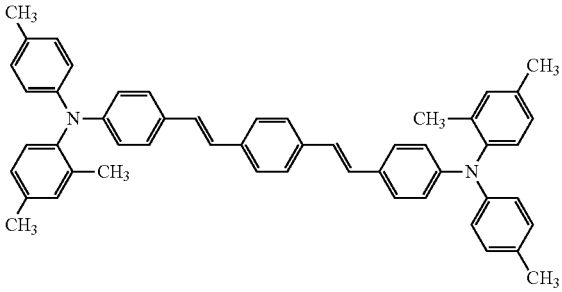
II-9
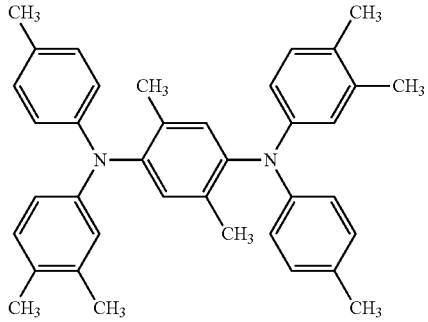
-continued
II-10
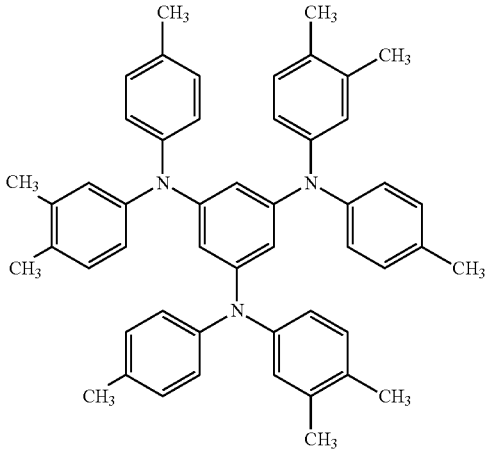
II-11
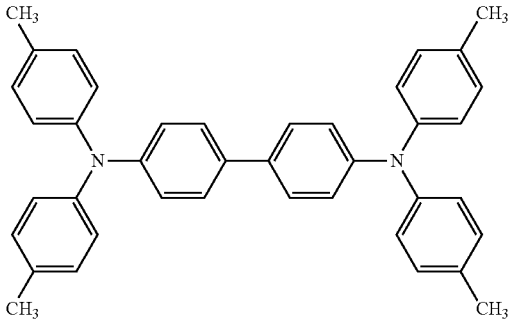
II-12
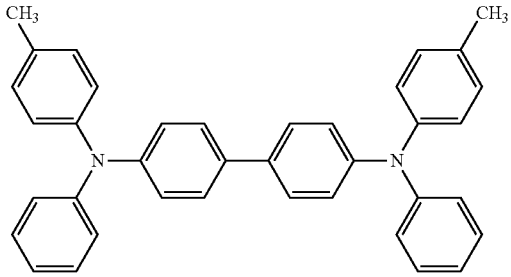
II-13
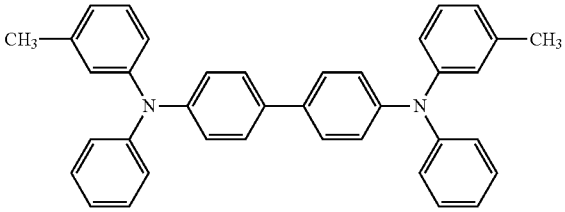

-continued

II-14

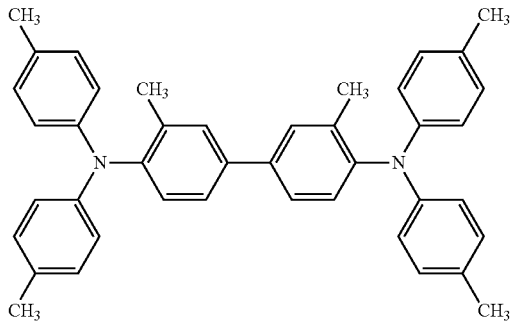

The content of the resin binder in the charge transport layer 5 is preferably from 20 to 90% by mass, and more preferably from 30 to 80% by mass, based on the solid content of the charge transport layer 5. The content of the hole transport material in the charge transport layer 5 is preferably from 9.8 to 71% by mass, and more preferably from 19.4 to 65.5% by mass, based on the solid content of the charge transport layer 5. The content of the electron transport material in the charge transport layer 5 is preferably from 0.2 to 9% by mass, more preferably from 0.6 to 4.5% by mass, based on the solid content of the charge transport layer 5.

Further, the film thickness of the charge transport layer 5 is preferably in the range of from 3 to 50 μm, and more preferably in the range of from 15 to 40 μm in order to maintain the practically effective surface electric potential.

Single-Layer Photoreceptor

In the present invention, the photosensitive layer 3 in the case of a single-layer type is mainly composed of an electric charge generating material, a hole transport material, an electron transport material (acceptor compound), and a resin binder.

As the electric charge generating material, for example, phthalocyanine type pigment, azo pigment, anthanthrone pigment, perylene pigment, perinone pigment, polycyclic quinone pigment, squarilium pigment, thiapyrylium pigment, quinacridone pigment, or the like can be used. These electric charge generating materials can be used singly or in combination of two or more. In particular, for the photoreceptor for electrophotography of the present invention, as an azo pigment, disazo pigment or trisazo pigment is preferable, as a perylene pigment, N,N'-bis(3,5-dimethylphenyl)-3,4:9,10-perylene-bis (carboximide) is preferable, and as a phthalocyanine pigment, metal free phthalocyanine, copper phthalocyanine, or titanyl phthalocyanine is preferable. Further, when X-type non-metal phthalocyanine, τ-type non-metal phthalocyanine, ε-type copper phthalocyanine, α-type titanyl phthalocyanine, β-type titanyl phthalocyanine, Y-type titanyl phthalocyanine, amorphous titanyl phthalocyanine, or titanyl phthalocyanine having a maximum peak at Bragg angle 2θ of 9.6° in the CuKα:X-ray diffraction spectrum described in Japanese Unexamined Patent Application Publication No. H08-209023, U.S. Pat. Nos. 5,736,282 and 5,874,570 is used, a remarkably improved effect is exhibited in terms of sensitivity, durability, and image quality. The content of the electric charge generating material is preferably from 0.1 to 20% by mass, and more preferably from 0.5 to 10% by mass, based on the solid content of the single-layer photosensitive layer 3.

As the hole transport material, for example, a hydrazone compound, a pyrazoline compound, a pyrazolone compound, an oxadiazole compound, an oxazole compound, an arylamine compound, a benzidine compound, a stilbene compound, a styryl compound, poly-N-vinylcarbazole, polysilane, or the like can be used. These hole transport materials can be used singly or in combination of two or more kinds. The hole transport material used in the present invention is preferably one which is excellent in the ability to transport holes generated upon light irradiation and is suitable for combination with an electric charge generating material. The content of the hole transport material is preferably from 3 to 80% by mass, and more preferably from 5 to 60% by mass, based on the solid content of the single-layer photosensitive layer 3.

In the present invention, when the single-layer photosensitive layer 3 is the outermost surface layer, as the electron transport material of the single-layer photosensitive layer 3, a compound having the structure represented by the general formula (ET2) is needed to be contained. Preferably, the electron transport material of the single-layer photosensitive layer 3 further contains one or both of the compounds having the structure represented by the above general formula (ET1) or (ET3), and other examples thereof include succinic anhydride, maleic anhydride, dibromosuccinic anhydride, phthalic anhydride, 3-nitro phthalic anhydride, 4-nitro phthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, a thiopyran compound, a quinone compound, a benzoquinone compound, a diphenoquinone compound, a naphthoquinone compound, an anthraquinone compound, a stilbenequinone compound, and an azoquinone compound. These electron transport materials can be used alone or in combination of two or more. The content of the electron transport material is preferably from 1 to 50% by mass, and more preferably from 5 to 40% by mass, based on the solid content of the single-layer photosensitive layer 3.

In the present invention, when the single-layer photosensitive layer 3 is the outermost surface layer, a polyarylate resin having the structural unit represented by the above chemical structural formula 1 is needed to be used as the resin binder of the single-layer photosensitive layer 3. Such a polyarylate resin may have another structural unit. When the total amount of the polyarylate resin is 100 mol %, the compounding ratio of the structural unit represented by the chemical structural formula 1 is preferably from 10 to 100 mol %, and particularly preferably from 50 to 100 mol %.

As the resin binder of the single-layer photosensitive layer 3, the polyarylate resin represented by the chemical structural formula 1 may be used alone, or may be used mixed with other resins. As such other resins, a variety of polycarbonate resins such as bisphenol A type, bisphenol Z type, bisphenol A type-biphenyl copolymer, or bisphenol Z type-biphenyl copolymer, polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resins, silicone resins, polyamide resins, polystyrene resins, polyacetal resins, other polyarylate resins, polysulfone resins, a polymer of a methacrylic acid ester, and a copolymer thereof. Further, the same kind of resins having different molecular weights may be mixed and used.

The content of the resin binder is preferably from 10 to 90% by mass, and more preferably from 20 to 80% by mass, with respect to the solid content of the single-layer photosensitive layer 3. Further, the content of the polyarylate resin with respect to the resin binder is suitably in the range of from 1% by mass to 100% by mass, and more preferably in the range of from 5% by mass to 80% by mass.

The film thickness of the single-layer photosensitive layer 3 is preferably in the range of from 3 to 100 μm, and more preferably in the range of from 5 to 40 μm in order to maintain a practically effective surface electric potential.

Positively Charged Multi-Layer Photoreceptor

In the positively charged multi-layer photoreceptor, the charge transport layer 5 is mainly composed of an electric charge transport material and a resin binder. As an electric charge transport material and a resin binder used for the charge transport layer 5 in the positively charged multi-layer photoreceptor, the same materials as those described in the embodiment of the charge transport layer 5 in the negatively charged multi-layer photoreceptor can be used. The content of each material and the film thickness of the charge transport layer 5 can also be made the same as in the case of the negatively charged multi-layer photoreceptor. For the charge transport layer 5 in the positively charged multi-layer photoreceptor, a polyarylate resin having a structural unit represented by the above chemical structural formula 1 as a resin binder can be arbitrarily used.

The charge generation layer 4 is mainly composed of an electric charge generating material, a hole transport material, an electron transport material, and a resin binder. As the electric charge generating material, the hole transport material, the electron transport material, and the resin binder, the same materials as those mentioned as embodiments of the single-layer photosensitive layer 3 in the single-layer photosensitive body can be used. The content of each material and the film thickness of the charge generation layer 4 can be the same as those of the single-layer photosensitive layer 3 in the single-layer photoreceptor. In the positively charged multi-layer photoreceptor, when the charge generation layer 4 is the outermost surface layer, a polyarylate resin having the structural unit represented by the chemical structural formula 1 is needed to be used as a resin binder of the charge generation layer 4 and a compound having the structure represented by the general formula (ET2) is needed to be used as the electron transport material of the charge generation layer 4, and preferably, a compound having the structure represented by the above general formula (ET1) or (ET3) is also used.

In the present invention, for the purpose of improving environmental resistance and stability against harmful light, an anti-deterioration agent such as an antioxidant or a light stabilizer can be contained in either a multi-layer type or a single-layer type photosensitive layer. Examples of a compound used for such purpose include chromanol derivatives and esterification compounds such as tocopherol, polyarylalkane compounds, hydroquinone derivatives, etherified compounds, dietherated compounds, benzophenone derivatives, benzothiazole derivatives, thioether compounds, phenylenediamine derivatives, phosphonate esters, phosphite esters, phenol compounds, hindered phenol compounds, linear amine compounds, cyclic amine compounds, and hindered amine compounds.

A leveling agent such as a silicone oil or a fluorine-based oil may be contained in the photosensitive layer for the purpose of improving the leveling property of the formed film and imparting lubricity. Further, for the purpose of adjusting film hardness, reducing friction coefficient, imparting lubricity, or the like, fine particles of metal oxides such as silicon oxide (silica), titanium oxide, zinc oxide, calcium oxide, aluminum oxide (alumina), or zirconium oxide, metal sulfides such as barium sulfate or calcium sulfate, or metal nitrides such as silicon nitride, or aluminum nitride, or fluorine-based resin particles such as tetrafluoroethylene resin, fluorine-based comb-type graft polymerization resin, or the like may be contained. Still further, as needed, other known additives may be contained within a range not significantly impairing the electrophotographic characteristics.

Further, in the present invention, the surface protective layer 6 can be provided on the surface of the photosensitive layer, as needed, for the purpose of further improving environmental resistance and mechanical strength. The surface protective layer 6 is preferably made of a material excellent in durability against mechanical stress and environmental resistance, and desirably has a capability of transmitting the light sensed by the charge generation layer with as low loss as possible.

The surface protective layer 6 is composed of a layer containing a resin binder as a main component, and fine particles of metal oxides such as silicon oxide (silica), titanium oxide, zinc oxide, calcium oxide, aluminum oxide (alumina) or zirconium oxide, metal sulfides such as barium sulfate or calcium sulfate, or metal nitrides such as silicon nitride or aluminum nitride, or particles of a fluororesin such as a tetrafluoroethylene resin, a fluorinated comb type graft polymer resin or the like may be contained in the resin binder for the purpose of improving conductivity, reducing friction coefficient, imparting lubricity, and the like.

For the purpose of imparting charge transportability, an electric charge transport material or an electron accepting material used for the photosensitive layer may be contained, and for the purpose of improving the leveling property of the formed film and imparting lubricity, leveling agents such as silicone oil and fluorine-based oil may be contained.

In the photoreceptor of the present invention, when the surface protective layer 6 is provided, a polyarylate resin having a structural unit represented by the chemical structural formula 1 as a resin binder and a compound having a structure represented by the general formula (ET2) as an electron transport material are contained in the surface protective layer 6 to be the outermost surface layer. By this, a desired effect of the present invention can be obtained.

The content of the resin binder in the surface protective layer 6 is preferably from 50 to 90% by mass, and more preferably from 70 to 90% by mass, based on the solid content of the surface protective layer 6. The content of fine particles of a metal oxide or a metal nitride or the like is preferably from 0 to 60% by mass, and more preferably from 10 to 50% by mass, based on the solid content of the surface protective layer 6. The content of the electric charge transport material and the electron transport material in the surface protective layer 6 is preferably from 0 to 30% by mass, and more preferably from 10 to 20% by mass, based on the solid content of the surface protective layer 6. Although the thickness of the surface protective layer 6 itself depends on the composition of the surface protective layer, the thickness can be arbitrarily set as long as no adverse effect such as increase in residual electric potential occurs when repeatedly and continuously used.

Method for Manufacturing a Photoreceptor

In manufacturing the photoreceptor of the present invention, in forming an outermost surface layer by coating a coating liquid on a conductive substrate, it is important that the coating liquid contains a polyarylate resin having a structural unit represented by the above chemical structural formula 1 and a compound having a structure represented by the above formula (ET2), thereby obtaining a photoreceptor capable of obtaining a desired effect of the present invention. The term "coating liquid for forming the outermost surface layer" refers to a coating liquid for forming a charge transport layer in a case in which the outermost surface layer is a photosensitive layer, in particular, a charge transport layer, a coating liquid for forming a charge generation layer in a case in which the outermost surface layer is a charge generation layer, a coating liquid for forming a single-layer photosensitive layer in a case in which the outermost surface layer is a single-layer photosensitive layer, or a coating liquid for forming a surface protective layer in a case in which the outermost surface layer is a surface protective layer. Such a coating liquid can be applied to a variety of coating methods such as a dip coating method or a spray coating method, but is not limited thereto.

Electrophotographic Device

The electrophotographic device of the present invention mounts a photoreceptor according to the present invention having at least a photosensitive layer on a conductive substrate and the outermost surface layer containing the predetermined polyarylate resin and compound, and by applying the device to a variety of machine processes, a desired effect can be obtained. Specifically, a sufficient effect can be obtained in a charging process such as a contact charging method using a charging member such as a roller or a brush or a non-contact charging method using a corotron, a scorotron or the like, and also in a developing process such as contact developing and non-contact developing system using a developing system (developing agent) such as nonmagnetic one component, magnetic one component, two-component or the like.

Figure 2:
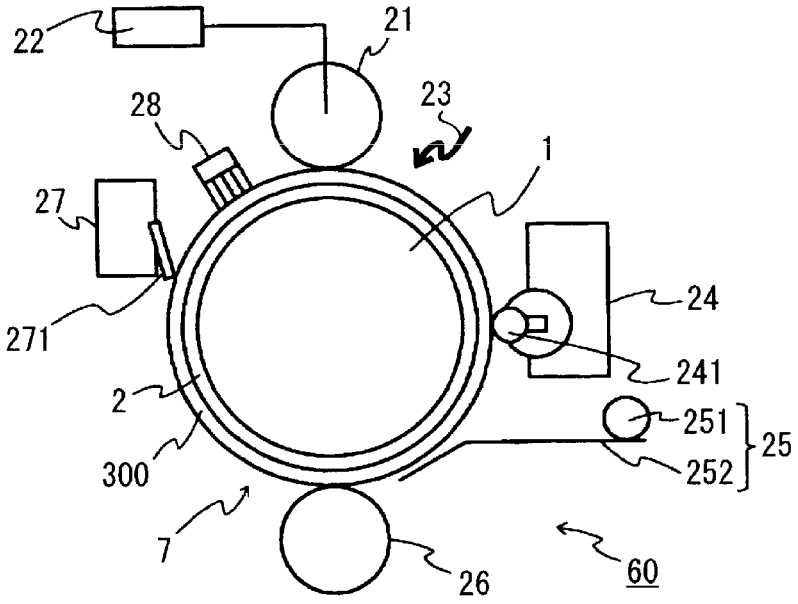
FIG. 2 is a schematic configuration diagram illustrating one configuration example of the electrophotographic device of the present invention.

As an example, FIG. 2 illustrates a schematic configuration diagram of an electrophotographic device according to the present invention. The illustrated electrophotographic device 60 mounts the photoreceptor for electrophotography 7 of the present invention including the conductive substrate 1, the undercoat layer 2 coated on the outer circumference thereof, and a photosensitive layer 300. More specifically, the illustrated electrophotographic device 60 is composed of a roller charging member 21 arranged at the outer circumference edge portion of the photoreceptor 7, a high voltage power supply 22 for supplying an applied voltage to the roller charging member 21, an image exposure member 23, a developer 24 provided with a developing roller 241, a paper feeding member 25 provided with a paper feeding roller 251 and a paper feed guide 252, a transfer charger (direct charging type) 26, a cleaning device 27 provided with a cleaning blade 271, and a charge removing member 28, and can be a color printer.

EXAMPLES

Hereinafter, specific embodiments of the present invention will be described in more detail by way of Examples, but the present invention is not limited by the following Examples as long as it goes beyond the gist thereof.

Manufacturing of a Negatively Charged Multi-Layer Photoreceptor

Example 1

Five parts by mass of alcohol-soluble nylon (trade name "CM8000" manufactured by Toray Industries, Inc.) and 5 parts by mass of aminosilane-treated titanium oxide fine particles were dissolved and dispersed in 90 parts by mass of methanol to prepare a coating liquid 1. This coating liquid 1 was dip coated on the outer circumference of an aluminum cylinder having an outer diameter of 30 mm as the conductive substrate 1, and dried at a temperature of 100° C. for 30 minutes to form an undercoat layer 2 having a thickness of 3 μm.

One part by mass of Y-type titanyl phthalocyanine as an electric charge generating material and 1.5 parts by mass of polyvinyl butyral resin (trade name "5-LEC KS-1" manufactured by Sekisui Chemical Co., Ltd.) as a resin binder were dissolved and dispersed in 60 parts by mass of dichloromethane to prepare a coating liquid 2. This coating liquid 2 was dip coated on the undercoat layer 2 and dried at a temperature of 80° C. for 30 minutes to form a charge generation layer 4 having a film thickness of 0.3 μm.

Ninety parts by mass of a compound represented by the following formula:

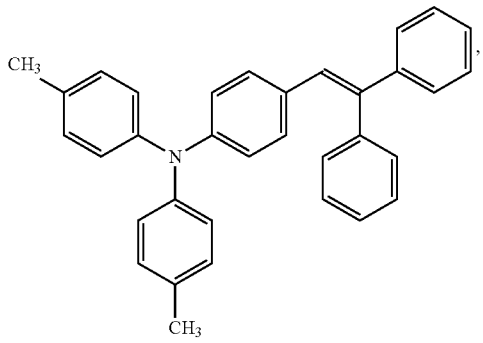

as an electric charge transport material, 110 parts by mass of a polyarylate resin represented by the structural formula (I-1) as a resin binder listed in Table 1, and 5 parts by mass of a compound represented by the structural formula (ET2-3) as an electron transport material were dissolved in 1,000 parts by mass of dichloromethane to prepare a coating liquid 3. The coating liquid 3 was dip coated on the charge generation layer 4 and dried at a temperature of 90° C. for 60 minutes to form a charge transport layer 5 having a film thickness of 25 μm to prepare a negatively charged multi-layer photoreceptor. The prepared photoreceptor was brought into contact with a charging roller and a transfer roller mounted on a printer LJ4250 manufactured by HP Inc. and left to stand in an environment of a temperature of 60° C. and a humidity of 90% for 30 days.

Examples 2 to 32

Photoreceptors were prepared in the same manner as in Example 1 except that the polyarylate resin represented by the structural formula (I-1) used in Example 1 was replaced with polyarylate resins represented by structural formulae (I-2) to (I-32), respectively. The prepared photoreceptor was left to stand for 30 days in the same manner as in Example 1.

Example 33

A photoreceptor was prepared in the same manner as in Example 1 except that the Y-type titanyl phthalocyanine used in Example 1 was replaced with α-type titanyl phthalocyanine. The prepared photoreceptor was left to stand for 30 days in the same manner as in Example 1.

Example 34

A charge transport layer was formed in the same manner as in Example 1 except that a compound represented by the structural formula (ET2-3) and a silicone oil as electron transport materials were excluded from the charge transport layer coating liquid used in Example 1 and the charge transport layer was formed with a film thickness of 20 μm. Thereafter, 80 parts by mass of a compound represented by the structural formula (II-1) as an electric charge transport material and 120 parts by mass of polyarylate resin represented by the structural formula (I-1) as a resin binder were dissolved in 900 parts by mass of dichloromethane, 0.1 parts by weight of Silicone oil (KP-340, manufactured by Shin-Etsu Polymer Co., Ltd.) was added and 12 parts by weight of a compound represented by the structural formula (ET2-3) as an electron transport material was added to prepare a coating liquid, which was further coated and formed on a layer thereon, and dried at a temperature of 90° C. for 60 minutes to form a surface protective layer having a film thickness of about 10 μm to prepare a photoreceptor for electrophotography. The prepared photoreceptor was left to stand for 30 days in the same manner as in Example 1.

Comparative Example 1

A photoreceptor was prepared in the same manner as in Example 1 except that the polyarylate resin represented by the structural formula (I-1) used in Example 1 was used, a compound represented by the structural formula (ET2-3) was not added as an electron transport material, and a charge transport layer was provided. The prepared photoreceptor was left to stand for 30 days in the same manner as in Example 1.

Comparative Example 2

A photoreceptor was prepared in the same manner as in Example 1 except that the polyarylate resin represented by the structural formula (I-1) used in Example 1 was changed to a polycarbonate resin (PCZ-500 manufactured by Mitsubishi Gas Chemical Co., Ltd.), and the charge transport layer was provided without adding a compound represented by the structural formula (ET2-3) as the electron transport material. The prepared photoreceptor was left to stand for 30 days in the same manner as in Example 1.

Comparative Example 3

A photoreceptor was prepared in the same manner as in Example 1 except that the polyarylate resin represented by the structural formula (I-1) used in Example 1 was changed to a polycarbonate resin (PCZ-500 manufactured by Mitsubishi Gas Chemical Co., Ltd.), and the charge transport layer was provided. The prepared photoreceptor was left to stand for 30 days in the same manner as in Example 1.

Comparative Example 4

A photoreceptor was prepared in the same manner as in Example 1 except that 110 parts by mass of the polyarylate resin represented by the structural formula (I-1) used in Example 1 was changed to 100 parts by mass of a polyarylate resin represented by the structural formula (I-1) and 10 parts by mass of a polycarbonate resin (PCZ-500 manufactured by Mitsubishi Gas Chemical Co., Ltd.), and the charge transport layer was provided without adding a compound represented by the structural formula (ET2-3) as the electron transport material. The prepared photoreceptor was left to stand for 30 days in the same manner as in Example 1.

Comparative Example 5

A photoreceptor was prepared in the same manner as in Example 1 except that 110 parts by mass of the polyarylate resin represented by the structural formula (I-1) used in Example 1 was changed to 55 parts by mass of a polyarylate resin represented by the structural formula (I-1) and 55 parts by mass of a polycarbonate resin (PCZ-500 manufactured by Mitsubishi Gas Chemical Co., Ltd.), and the charge transport layer was provided without adding a compound represented by the structural formula (ET2-3) as the electron transport material. The prepared photoreceptor was left to stand for 30 days in the same manner as in Example 1.

Comparative Example 6

A photoreceptor was prepared in the same manner as in Example 1 except that 110 parts by mass of the polyarylate resin represented by the structural formula (I-1) used in Example 1 was changed to 10 parts by mass of a polyarylate resin represented by the structural formula (I-1) and 100 parts by mass of a polycarbonate resin (PCZ-500 manufactured by Mitsubishi Gas Chemical Co., Ltd.), and the charge transport layer was provided without adding a compound represented by the structural formula (ET2-3) as the electron transport material. The prepared photoreceptor was left to stand for 30 days in the same manner as in Example 1.

Stain Resistance

The photoreceptors prepared in Examples 1 to 34 and Comparative Examples 1 to 6 were left to stand in an environment of a temperature of 60° C. and a humidity of 90% for 30 days, and then, images of halftone images were taken out and evaluated according to the following:

○: No black stripes occurred in a halftone image; and x: Black streak occurred in a halftone image.

Electric Characteristics

The photoreceptors prepared in Examples 1 to 34 and Comparative Examples 1 to 6 were mounted on a printer LJ4250 manufactured by HP Inc. provided with a charging roller and a transfer roller and evaluated by the following method. Specifically, after the surface of the photoreceptor was charged to −650 V by corona discharge in a dark place, the surface electric potential V0 immediately after charging was measured Subsequently, the corona discharge was left to stand in a dark place for 5 seconds, then the surface potential V5 was measured, and the electric potential retention rate Vk5(%) at 5 seconds after charging was determined according to the following formula (1):

$$Vk5=V5/V0\times100 \quad (1).$$

Next, using a halogen lamp as a light source, exposure light split into 780 nm with a filter was irradiated to the photoreceptor for 5 seconds from the time when the surface electric potential reached −600 V. The exposure needed for light attenuation until the surface electric potential became −300 V was determined as E1/2 ($\mu Jcm^{-2}$), and the residual electric potential on the surface of the photoreceptor 5 seconds after exposure was determined as Vr5 (−V).

Next, the photoreceptor was left for 10 minutes under a fluorescent light of 1,500 (lx·s), and electric potentials before and after leaving were measured as light fatigue characteristics using a photoreceptor drum electric characteristics evaluating device. Regarding the electric potential in the light fatigue characteristics, while the drum was rotated, the charged electric potential V0 was measured so that the charged electric potential V0 is about −600 V, and subsequently, a bright portion electric potential VL was measured by irradiating light of 780 nm and 2 μW/cm$^2$ for 0.25 seconds.

The electric characteristics, light fatigue characteristics, and stain resistance of the photoreceptors prepared in Examples 1 to 34 and Comparative Examples 1 to 6 as the above measurement results are listed on the following Tables. In the Tables, "Before" and "After" mean before and after leaving to stand, respectively.

TABLE 2

| | | | | | Light fatigue characteristics | | | | | | |
|---|---|---|---|---|---|---|---|---|---|---|---|
| | | | | | Charged electric potential VO(−V) | | | Bright portion electric potential VL(−V) | | | |
| | VO(−V) | Vk5(%) | E½(μJcm$^{-2}$) | Vr5(−V) | Before | After | Change amount | Before | After | Change amount | Stain resistance |
| Example 1 | 653 | 94.7 | 0.16 | 13 | 600 | 585 | −15 | 110 | 105 | −5 | ○ |
| Example 2 | 655 | 92.7 | 0.15 | 12 | 590 | 575 | −15 | 115 | 105 | −10 | ○ |
| Example 3 | 651 | 95.3 | 0.17 | 14 | 595 | 585 | −10 | 115 | 110 | −5 | ○ |
| Example 4 | 649 | 93.2 | 0.15 | 10 | 595 | 580 | −15 | 125 | 115 | −10 | ○ |
| Example 5 | 650 | 93.4 | 0.15 | 15 | 590 | 580 | −10 | 120 | 110 | −10 | ○ |
| Example 6 | 653 | 93.2 | 0.12 | 13 | 585 | 575 | −10 | 115 | 105 | −10 | ○ |
| Example 7 | 653 | 92.9 | 0.16 | 12 | 595 | 585 | −10 | 110 | 110 | 0 | ○ |
| Example 8 | 654 | 94.2 | 0.14 | 16 | 595 | 585 | −10 | 115 | 110 | −5 | ○ |
| Example 9 | 651 | 94.9 | 0.16 | 15 | 600 | 590 | −10 | 130 | 120 | −10 | ○ |
| Example 10 | 652 | 94.3 | 0.17 | 13 | 600 | 595 | −5 | 125 | 120 | −5 | ○ |
| Example 11 | 648 | 94.8 | 0.16 | 14 | 585 | 585 | 0 | 135 | 125 | −10 | ○ |
| Example 12 | 655 | 95.5 | 0.14 | 10 | 590 | 595 | 5 | 130 | 115 | −15 | ○ |
| Example 13 | 653 | 94.6 | 0.16 | 15 | 590 | 590 | 0 | 140 | 125 | −15 | ○ |
| Example 14 | 654 | 94.3 | 0.14 | 12 | 585 | 580 | −5 | 125 | 115 | −10 | ○ |
| Example 15 | 651 | 94.7 | 0.16 | 11 | 595 | 580 | −15 | 135 | 125 | −10 | ○ |
| Example 16 | 651 | 93.3 | 0.17 | 16 | 595 | 590 | −5 | 115 | 110 | −5 | ○ |
| Example 17 | 652 | 93.2 | 0.15 | 12 | 600 | 590 | −10 | 110 | 110 | 0 | ○ |
| Example 18 | 654 | 95.4 | 0.14 | 15 | 600 | 595 | −5 | 115 | 110 | −5 | ○ |
| Example 19 | 655 | 93.2 | 0.12 | 17 | 585 | 580 | −5 | 120 | 120 | 0 | ○ |
| Example 20 | 652 | 94.9 | 0.16 | 12 | 590 | 590 | 0 | 120 | 105 | −15 | ○ |
| Example 21 | 651 | 94.2 | 0.15 | 12 | 585 | 580 | −5 | 115 | 110 | −5 | ○ |
| Example 22 | 653 | 94.9 | 0.16 | 14 | 595 | 585 | −10 | 135 | 125 | −10 | ○ |
| Example 23 | 651 | 94.6 | 0.17 | 13 | 595 | 590 | −5 | 140 | 125 | −15 | ○ |
| Example 24 | 651 | 93.2 | 0.17 | 10 | 590 | 585 | −5 | 135 | 125 | −10 | ○ |
| Example 25 | 655 | 94.1 | 0.15 | 11 | 600 | 590 | −10 | 135 | 120 | −15 | ○ |
| Example 26 | 654 | 94.2 | 0.16 | 11 | 585 | 580 | −5 | 125 | 115 | −10 | ○ |
| Example 27 | 652 | 95.3 | 0.12 | 14 | 595 | 585 | −10 | 135 | 130 | −5 | ○ |
| Example 28 | 649 | 92.8 | 0.15 | 15 | 590 | 580 | −10 | 125 | 120 | −5 | ○ |

TABLE 3

| | | | | | Light fatigue characteristics | | | | | | |
|---|---|---|---|---|---|---|---|---|---|---|---|
| | | | | | Charged electric potential VO (−V) | | | Bright portion electric potential VL (−V) | | | |
| | VO (−V) | Vk5 (%) | E½(μJcm$^{-2}$) | Vr5 (−V) | Before | After | Change amount | Before | After | Change amount | Stain resistance |
| Example 29 | 650 | 93.8 | 0.14 | 11 | 595 | 585 | −10 | 115 | 105 | −10 | ○ |
| Example 30 | 655 | 93.5 | 0.15 | 14 | 600 | 590 | −10 | 110 | 105 | −5 | ○ |
| Example 31 | 652 | 95.3 | 0.13 | 14 | 590 | 585 | −5 | 110 | 110 | 0 | ○ |
| Example 32 | 649 | 92.8 | 0.15 | 12 | 595 | 595 | 0 | 115 | 105 | −10 | ○ |
| Example 33 | 652 | 93.4 | 0.13 | 15 | 595 | 580 | −15 | 120 | 110 | −10 | ○ |
| Example 34 | 653 | 94.3 | 0.12 | 15 | 590 | 580 | −10 | 110 | 105 | −5 | ○ |
| Comparative Example 1 | 651 | 93.5 | 0.15 | 15 | 590 | 645 | 55 | 125 | 350 | 225 | ○ |
| Comparative Example 2 | 651 | 94.6 | 0.17 | 14 | 590 | 580 | −10 | 125 | 115 | −10 | x |
| Comparative Example 3 | 650 | 93.6 | 0.16 | 14 | 595 | 585 | −10 | 115 | 110 | −5 | x |
| Comparative Example 4 | 651 | 94.1 | 0.14 | 35 | 595 | 635 | 40 | 150 | 345 | 195 | ○ |
| Comparative Example 5 | 655 | 93.9 | 0.17 | 20 | 600 | 650 | 50 | 165 | 335 | 170 | ○ |
| Comparative Example 6 | 653 | 94.5 | 0.14 | 33 | 595 | 645 | 50 | 140 | 320 | 180 | ○ |

From the results in the above Tables, it was revealed that by using a combination of a specific polyarylate resin and an electron transport material with the outermost surface layer, it is possible to realize a photoreceptor having excellent electric characteristics, no light fatigue, and sufficient stain resistance.

Manufacturing of a Positively Charged Single-Layer Photoreceptor

Example 35

A coating liquid prepared by stirring and dissolving 0.2 parts by mass of vinyl chloride-vinyl acetate-vinyl alcohol copolymer (trade name "SOLVINE TA5R" manufactured by Nissin Chemical Co., Ltd.) as an undercoat layer in 99 parts by mass of methyl ethyl ketone was applied by dip coating to the outer circumference of an aluminum cylinder with outer diameter of 24 mm as a conductive substrate 1, and dried at a temperature of 100° C. for 30 minutes to form an undercoat layer 2 having a thickness of 0.1 μm.

A coating liquid prepared by dissolving and dispersing 1 part by mass of metal-free phthalocyanine represented by the following formula:

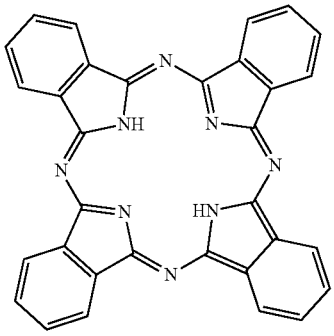

as an electric charge generating material, 30 parts by mass of a stilbene compound represented by the following formula:

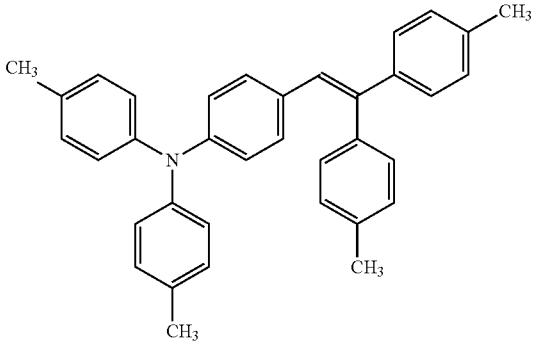

as a hole transport material, 15 parts by mass of a stilbene compound represented by the following formula:

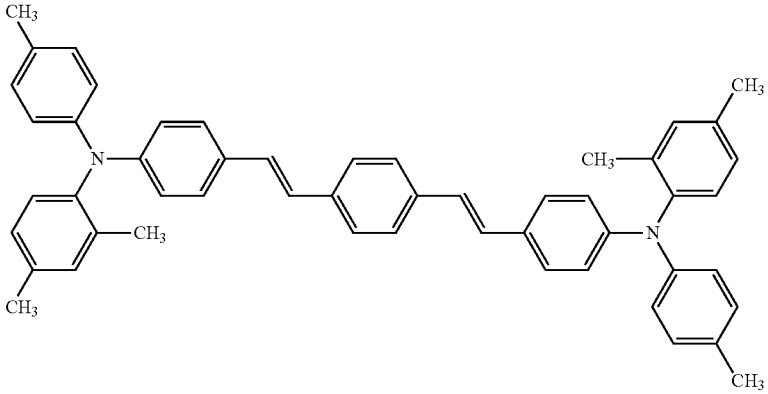

30 parts by mass of a compound represented by the following formula:

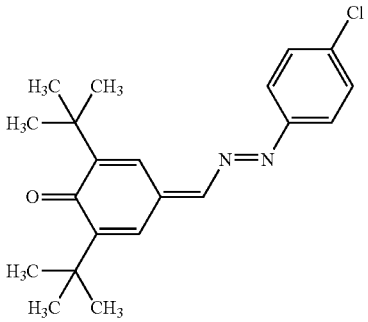

as an electron transport material, 55 parts by mass of a polyarylate resin represented by the structural formula (I-1) as a resin binder, and 3 parts by mass of a compound represented by the structural formula (ET2-3) as an electron transport material in 350 parts by mass of tetrahydrofuran was coated on the undercoat layer 2 by dip coating, and dried at a temperature of 100° C. for 60 minutes to form a photosensitive layer having a film thickness of 25 μm to prepare a single-layer photoreceptor. The prepared photoreceptor was left to stand for 30 days in the same manner as in Example 1.

Example 36

A photoreceptor was prepared in the same manner as in Example 35 except that the metal-free phthalocyanine used in Example 35 was changed to Y-type titanyl phthalocyanine. The prepared photoreceptor was left to stand for 30 days in the same manner as in Example 1.

Example 37

A photoreceptor was prepared in the same manner as in Example 35 except that the metal-free phthalocyanine used in Example 35 was changed to α-type titanyl phthalocyanine.
The prepared photoreceptor was left to stand for 30 days in the same manner as in Example 1.

Comparative Example 7

A photoreceptor was prepared in the same manner as in Example 35 except that the polyarylate resin represented by the structural formula (I-1) used in Example 35 was used and the electron transport material was not added. The prepared photoreceptor was left to stand for 30 days in the same manner as in Example 1.

Comparative Example 8

A photoreceptor was prepared in the same manner as in Example 35 except that the polyarylate resin represented by the structural formula (I-1) used in Example 35 was changed to a polycarbonate resin (PCZ-500 manufactured by Mitsubishi Gas Chemical Co., Ltd.), and no electron transport material was added. The prepared photoreceptor was left to stand for 30 days in the same manner as in Example 1.

Comparative Example 9

A photoreceptor was prepared in the same manner as in Example 35 except that the polyarylate resin represented by the structural formula (I-1) used in Example 35 was changed to a polycarbonate resin (PCZ-500 manufactured by Mitsubishi Gas Chemical Co., Ltd.). The prepared photoreceptor was left to stand for 30 days in the same manner as in Example 1.

Comparative Example 10

A photoreceptor was prepared in the same manner as in Example 35 except that 55 parts by mass of the polyarylate resin represented by the structural formula (I-1) used in Example 35 was changed to 50 parts by mass of a polyarylate resin represented by the structural formula (I-1) and 5 parts by mass of a polycarbonate resin (PCZ-500 manufactured by Mitsubishi Gas Chemical Co., Ltd.), and no electron transport material was added. The prepared photoreceptor was left to stand for 30 days in the same manner as in Example 1.

Comparative Example 11

A photoreceptor was prepared in the same manner as in Example 35 except that 55 parts by mass of the polyarylate resin represented by the structural formula (I-1) used in Example 35 was changed to 30 parts by mass of a polyarylate resin represented by the structural formula (I-1) and 25 parts by mass of a polycarbonate resin (PCZ-500 manufactured by Mitsubishi Gas Chemical Co., Ltd.), and no electron transport material was added. The prepared photoreceptor was left to stand for 30 days in the same manner as in Example 1.

Comparative Example 12

A photoreceptor was prepared in the same manner as in Example 35 except that 55 parts by mass of the polyarylate resin represented by the structural formula (I-1) used in Example 35 was changed to 5 parts by mass of a polyarylate resin represented by the structural formula (I-1) and 50 parts by mass of a polycarbonate resin (PCZ-500 manufactured by Mitsubishi Gas Chemical Co., Ltd.), and no electron transport material was added. The prepared photoreceptor was left to stand for 30 days in the same manner as in Example 1.

Stain Resistance

The photoreceptors prepared in Examples 35 to 37 and Comparative Examples 7 to 12 were left to stand in an environment of a temperature of 60° C. and a humidity of 90% for 30 days, and then, images of halftone images were taken out and evaluated according to the following:

○: No black stripes occurred in a halftone image; and x: Black streak occurred in a halftone image.

Electric Characteristics

The photoreceptors prepared in Examples 35 to 37 and Comparative Examples 7 to 12 were mounted on a printer HL-2040 manufactured by Brother Co., Ltd. provided with a charging roller and a transfer roller and evaluated by the following method. Specifically, after the surface of the photoreceptor was charged to +650 V by corona discharge in a dark place, the surface electric potential V0 immediately after charging was measured. Subsequently, the photoreceptor was left to stand in a dark place for 5 seconds, then the surface potential V5 was measured, and the electric potential retention rate Vk5(%) at 5 seconds after charging was determined according to the following formula (1):

$$Vk5=V5/V0\times100 \quad (1).$$

Next, using a halogen lamp as a light source, exposure light having 1.0 $\mu W/cm^2$ split into 780 nm with a filter was irradiated to the photoreceptor for 5 seconds from the time when the surface electric potential reached +600 V. The exposure needed for light attenuation until the surface electric potential became +300 V was determined as E1/2 ($\mu Jcm^{-2}$), and the residual electric potential on the surface of the photoreceptor 5 seconds after exposure was determined as Vr5 (−V).

Next, the photoreceptor was left for 10 minutes under a fluorescent light of 1,500 (lx·s), and electric potentials before and after leaving were measured as light fatigue characteristics using a photoreceptor drum electric characteristics evaluating device. Regarding the electric potential in the light fatigue characteristics, while the drum was rotated, the charged electric potential V0 was measured so that the charged electric potential V0 is about +650 V, and subsequently, a bright portion electric potential VL was measured by irradiating light of 780 nm and 2 $\mu W/cm^2$ for 0.25 seconds.

The electric characteristics, light fatigue characteristics, and stain resistance of the photoreceptors prepared in Examples 35 to 37 and Comparative Examples 7 to 12 as the above measurement results are listed on the following Tables. In the Tables, "Before" and "After" mean before and after leaving to stand, respectively.

TABLE 4

| | | | | | Light fatigue characteristics | | | | | | |
|---|---|---|---|---|---|---|---|---|---|---|---|
| | | | | | Charged electric potential VO(+V) | | | Bright portion electric potential VL (+V) | | | |
| | VO(+V) | Vk5 (%) | E½ (μJcm$^{-2}$) | Vr5 (V) | Before | After | Change amount | Before | After | Change amount | Stain resistance |
| Example 35 | 655 | 92.9 | 0.15 | 12 | 600 | 590 | −10 | 115 | 105 | −10 | ○ |
| Example 36 | 650 | 93.8 | 0.13 | 13 | 585 | 580 | −5 | 110 | 105 | −5 | ○ |
| Example 37 | 654 | 94.9 | 0.14 | 15 | 590 | 580 | −10 | 125 | 120 | −5 | ○ |
| Comparative Example 7 | 654 | 94.5 | 0.16 | 16 | 593 | 643 | 55 | 125 | 350 | 225 | ○ |
| Comparative Example 8 | 652 | 93.2 | 0.14 | 12 | 595 | 580 | −15 | 140 | 130 | −10 | x |
| Comparative Example 9 | 654 | 94.0 | 0.14 | 12 | 595 | 590 | −5 | 120 | 105 | −15 | x |
| Comparative Example 10 | 653 | 95.1 | 0.15 | 32 | 596 | 635 | 39 | 155 | 343 | 188 | ○ |
| Comparative Example 11 | 652 | 94.9 | 0.17 | 23 | 601 | 652 | 51 | 163 | 332 | 169 | ○ |
| Comparative Example 12 | 653 | 93.5 | 0.16 | 27 | 597 | 645 | 48 | 148 | 327 | 17I9 | ○ |

From the results in the above Table, it was revealed that by using a combination of a specific polyarylate resin and an electron transport material with the outermost surface layer, it is possible to realize a photoreceptor having excellent electric characteristics, no light fatigue, and sufficient stain resistance.

Manufacturing of Positively Charged Multi-Layer Photoreceptor

Example 38

Fifty parts by mass of a compound represented by the following formula:

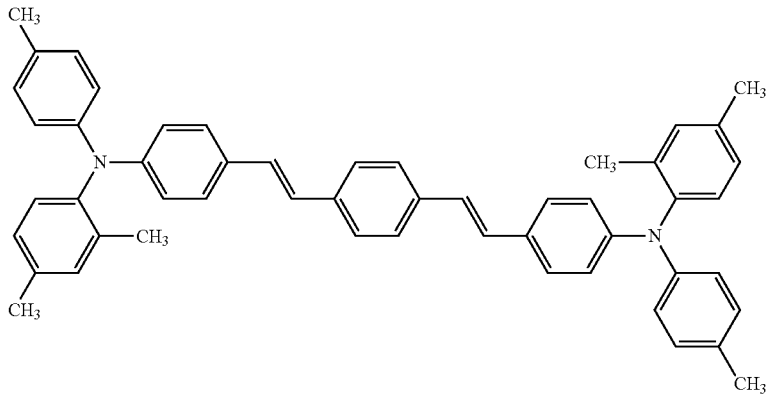

as an electric charge transport material and 50 parts by mass of a polycarbonate resin (PCZ-500 manufactured by Mitsubishi Gas Chemical Company, Inc.) as a resin binder were dissolved in 800 parts by mass of dichloromethane to prepare a coating liquid. This coating liquid was dip coated on the outer circumference of an aluminum cylinder having an outer diameter of 24 mm as a conductive substrate and dried at a temperature of 120° C. for 60 minutes to form a charge transport layer having a film thickness of 15 μm.

A coating liquid prepared by dissolving and dispersing 1.5 parts by mass of metal-free phthalocyanine represented by the following formula:

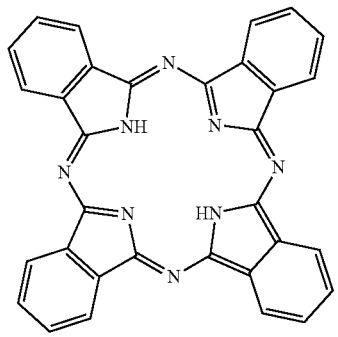

as an electric charge generating material, 10 parts by mass of a stilbene compound represented by the following formula:

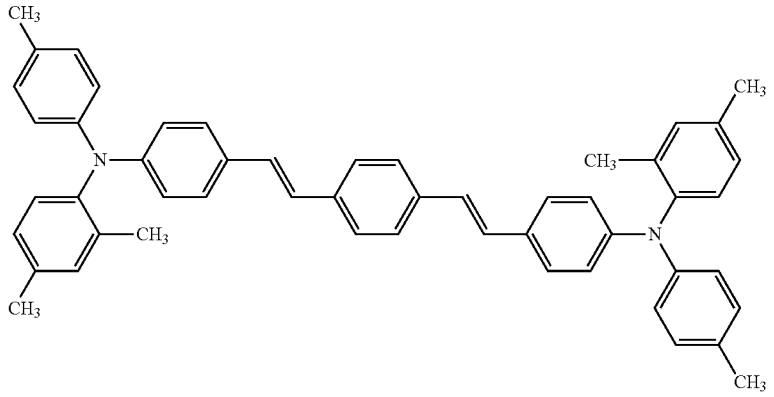

as a hole transport material, 25 parts by mass of a compound represented by the following formula:

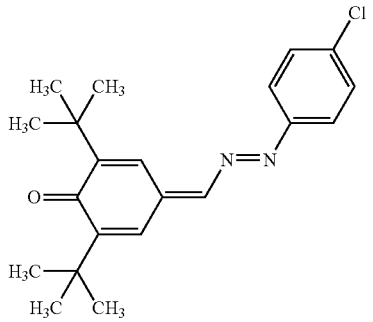

as an electron transport material, 60 parts by mass of a polyarylate resin represented by the structural formula (I-1) as a resin binder, and 3 parts by mass of a compound represented by the structural formula (ET2-3) as an electron transport material in 800 parts by mass of 1,2-dichloro ethane was coated on the charge transport layer by dip coating, and dried at a temperature of 100° C. for 60 minutes to form a photosensitive layer having a film thickness of 15 μm to prepare a positively charged multi-layer photoreceptor. The prepared photoreceptor was left to stand for 30 days in the same manner as in Example 1.

Comparative Example 13

A photoreceptor was prepared in the same manner as in Example 38 except that the polyarylate resin represented by the structural formula (I-1) used in Example 38 was used and the electron transport material was not added. The prepared photoreceptor was left to stand for 30 days in the same manner as in Example 1.

Comparative Example 14

A photoreceptor was prepared in the same manner as in Example 38 except that the polyarylate resin represented by the structural formula (I-1) used in Example 38 was changed to a polycarbonate resin (PCZ-500 manufactured by Mitsubishi Gas Chemical Co., Ltd.), and no electron transport material was added. The prepared photoreceptor was left to stand for 30 days in the same manner as in Example 1.

Comparative Example 15

A photoreceptor was prepared in the same manner as in Example 38 except that the polyarylate resin represented by the structural formula (I-1) used in Example 38 was changed to a polycarbonate resin (PCZ-500 manufactured by Mitsubishi Gas Chemical Co., Ltd.). The prepared photoreceptor was left to stand for 30 days in the same manner as in Example 1.

Comparative Example 16

A photoreceptor was prepared in the same manner as in Example 38 except that 60 parts by mass of the polyarylate resin represented by the structural formula (I-1) used in Example 38 was changed to 50 parts by mass of a polyarylate resin represented by the structural formula (I-1) and 10 parts by mass of a polycarbonate resin (PCZ-500 manufactured by Mitsubishi Gas Chemical Co., Ltd.), and no electron transport material was added. The prepared photoreceptor was left to stand for 30 days in the same manner as in Example 1.

Comparative Example 17

A photoreceptor was prepared in the same manner as in Example 38 except that 60 parts by mass of the polyarylate resin represented by the structural formula (I-1) used in Example 38 was changed to 30 parts by mass of a polyarylate resin represented by the structural formula (I-1) and 30 parts by mass of a polycarbonate resin (PCZ-500 manufactured by Mitsubishi Gas Chemical Co., Ltd.), and no electron transport material was added. The prepared photoreceptor was left to stand for 30 days in the same manner as in Example 1.

Comparative Example 18

A photoreceptor was prepared in the same manner as in Example 38 except that 60 parts by mass of the polyarylate resin represented by the structural formula (I-1) used in Example 38 was changed to 10 parts by mass of a polyarylate resin represented by the structural formula (I-1) and 50 parts by mass of a polycarbonate resin (PCZ-500 manufactured by Mitsubishi Gas Chemical Co., Ltd.), and no electron transport material was added. The prepared photoreceptor was left to stand for 30 days in the same manner as in Example 1.

The photoreceptors prepared in Example 38 and Comparative Examples 13 to 18 were evaluated in the same manner as in Example 35 or the like.

The electric characteristics, light fatigue characteristics, and stain resistance of the photoreceptors prepared in Example 38 and Comparative Examples 13 to 18 as the above measurement results are listed on the following Tables. In the Tables, "Before" and "After" mean before and after leaving to stand, respectively.

TABLE 5

| | | | | | Light fatigue characteristics | | | | | | |
|---|---|---|---|---|---|---|---|---|---|---|---|
| | | | | | Charged electric potential VO(+V) | | | Bright portion electric potential VL (+V) | | | |
| | VO(+V) | Vk5 (%) | E½ (μJcm$^{-2}$) | Vr5 (V) | Before | After | Change amount | Before | After | Change amount | Stain resistance |
| Example 38 | 652 | 94.6 | 0.17 | 15 | 595 | 595 | 0 | 130 | 120 | −10 | ○ |
| Comparative Example 13 | 657 | 94.3 | 0.18 | 15 | 592 | 648 | 56 | 122 | 328 | 206 | ○ |
| Comparative Example 14 | 655 | 93.6 | 0.15 | 14 | 590 | 585 | −5 | 115 | 105 | −10 | x |
| Comparative Example 15 | 651 | 94.0 | 0.17 | 15 | 595 | 580 | −15 | 125 | 115 | −10 | x |
| Comparative Example 16 | 653 | 95.4 | 0.15 | 32 | 598 | 638 | 40 | 155 | 348 | 193 | ○ |
| Comparative Example 17 | 651 | 92.7 | 0.17 | 25 | 602 | 653 | 51 | 169 | 339 | 170 | ○ |
| Comparative Example 18 | 655 | 93.5 | 0.18 | 22 | 596 | 645 | 49 | 151 | 328 | 177 | ○ |

From the results in the above Table, it was revealed that by using a combination of a specific polyarylate resin and an electron transport material with the outermost surface layer, it is possible to realize a photoreceptor having excellent electric characteristics, no light fatigue, and sufficient stain resistance.

What is claimed is:

1. A photoreceptor for electrophotography, comprising:

a conductive substrate;

a photosensitive layer that is provided on the conductive substrate and that has an outermost surface layer containing at least a resin binder and an electron transport material, the resin binder being comprised of a polyarylate resin having a structural unit represented by Chemical Structural Formula 1 below, and the electron transport material being comprised of a compound having a structure represented by Structural Formula (ET2-3) below, Chemical Structural Formula 1:

(A1)

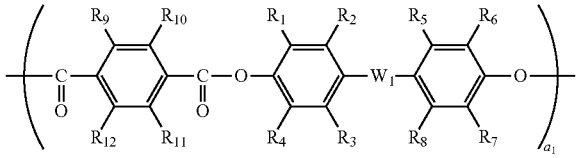

(A2)

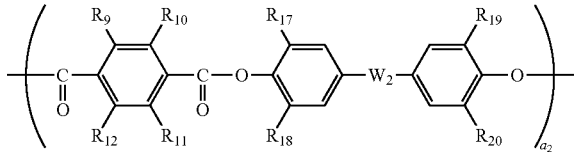

-continued (B1)

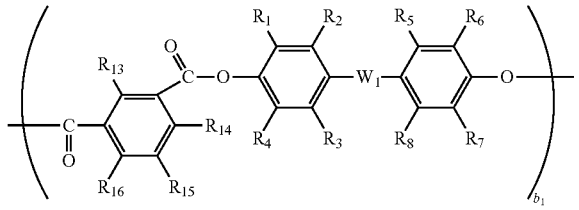

(B2)

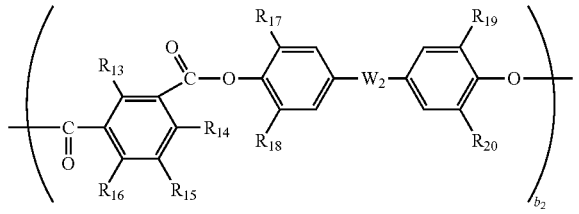

-continued (C)

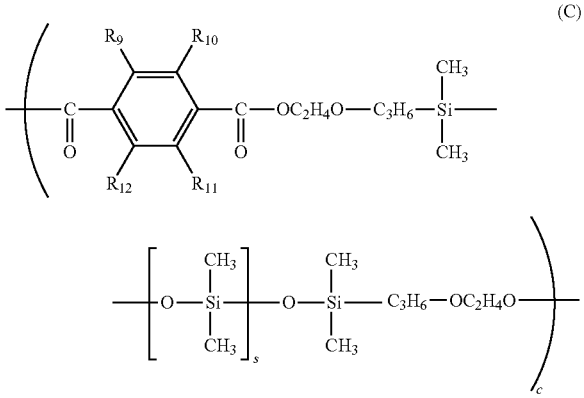

(D)

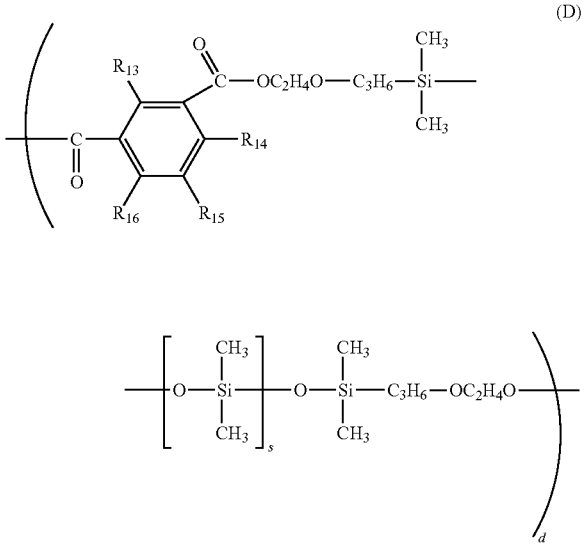

(E)

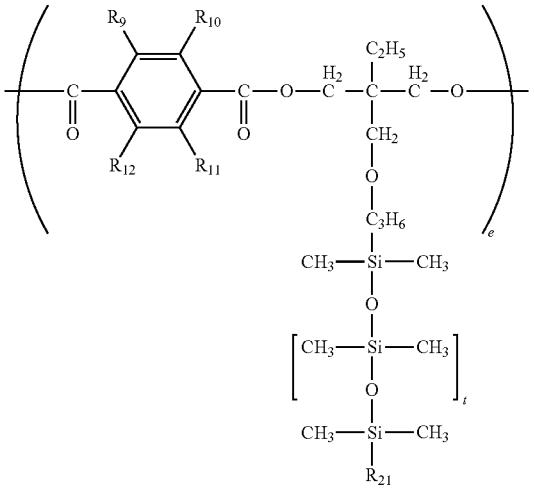

-continued (F)

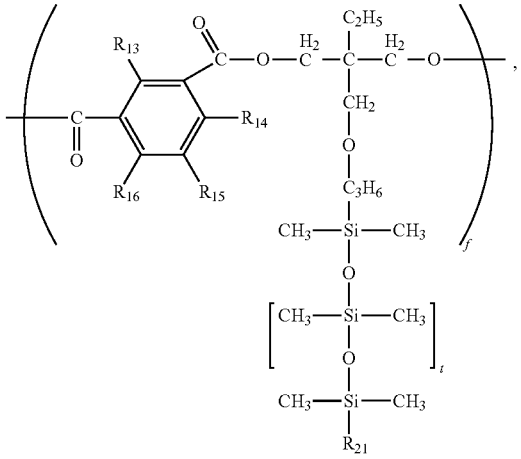

where partial structural formulae ($A_1$), ($A_2$), ($B_1$), ($B_2$), (C), (D), (E), and (F) represent respective structural units constituting the resin binder, $a_1$, $a_2$, $b_1$, $b_2$, c, d, e, and f represents mol % of the respective structural units ($A_1$), ($A_2$), ($B_1$), ($B_2$), (C), (D), (E), and (F), where $a_1$, $a_2$, $b_1$, and $b_2$ are not zero, where $a_1+a_2+b_1+b_2+c+d+e+f$ is 100 mol %, and where c+d+e+f range from greater than 0 up to 10 mol % and e and f are not both zero mol %;

$W_1$ and $W_2$ are different, $W_1$ is selected from the group consisting of a single bond, —O—, and —$CR_{22}R_{23}$—, where C is a carbon atom and $R_{22}$ and $R_{23}$ are different, are monovalently bonded to the carbon atom of —$CR_{22}R_{23}$—, and are respectively selected from the group consisting of a hydrogen atom, an alkyl group having from 1 to 12 carbon atoms, a halogenated alkyl group, and a substituted or unsubstituted aryl group having from 6 to 12 carbon atoms; and $W_2$ is selected from the group consisting of a single bond, —O—, and —$CR_{22}R_{23}$—, where $R_{22}$ and $R_{23}$ are the same or different and are respectively selected from the group consisting of a hydrogen atom and an alkyl group having 1 carbon atom, wherein, in the partial structural formulas ($A_1$) and ($B_1$), when the group $W_1$ is —$CR_{22}R_{23}$—, the groups $R_{22}$ and $R_{23}$ may bond together to form a cyclohexylidene group, and $R_1$ to $R_{20}$ are the same or different and are respectively selected from the group consisting of a hydrogen atom, an alkyl group having from 1 to 8 carbon atoms, a fluorine atom, a chlorine atom, or a bromine atom; $R_{21}$ represents a hydrogen atom, an alkyl group having from 1 to 20 carbon atoms, an aryl group optionally containing a substituent, a cycloalkyl group optionally containing a substituent, a fluorine atom, a chlorine atom, and a bromine atom, and s and t each represent an integer of 1 or more, and Structural Formula (ET2-3):

(ET2-3)

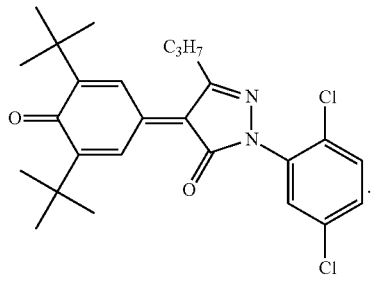

2. The photoreceptor for electrophotography according to claim 1, wherein the electron transport material further contains one or both of compounds having a structure represented by General Formulae (ET1) and (ET3) below, (ET1)

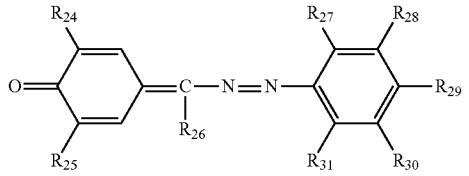

where, in the General Formula (ET1):

$R_{24}$ and $R_{25}$ are the same or different and respectively represent one of a hydrogen atom, an alkyl group having from 1 to 12 carbon atoms, an alkoxy group having from 1 to 12 carbon atoms, an aryl group optionally containing a substituent, a cycloalkyl group, an aralkyl group optionally containing a substituent, or a halogenated alkyl group;

$R_{26}$ represents a hydrogen atom, an alkyl group having from 1 to 6 carbon atoms, an alkoxy group having from 1 to 6 carbon atoms, an aryl group optionally containing a substituent, a cycloalkyl group, an aralkyl group optionally containing a substituent, or a halogenated alkyl group; and $R_{27}$ to $R_{31}$ are the same or different and respectively represent one of a hydrogen atom, a halogen atom, an alkyl group having from 1 to 12 carbon atoms, an alkoxy group having from 1 to 12 carbon atoms, an aryl group optionally containing a substituent, an aralkyl group optionally containing a substituent, a phenoxy group optionally containing a substituent, a halogenated alkyl group, a cyano group, or a nitro group, and two or more groups may be bonded to each other to form a ring, in which the substituent represents a halogen atom, an alkyl group having from 1 to 6 carbon atoms, an alkoxy group having from 1 to 6 carbon atoms, a hydroxyl group, a cyano group, an amino group, a nitro group, or a halogenated alkyl group, and (ET3)

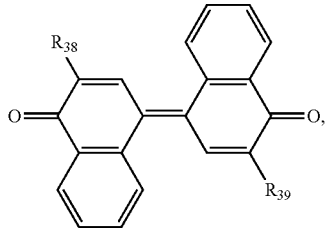

where, in the General Formula (ET3):

$R_{38}$ and $R_{39}$ are the same or different and respectively represent one of a hydrogen atom, a halogen atom, a cyano group, a nitro group, a hydroxyl group, an alkyl group having from 1 to 12 carbon atoms, an alkoxy group having from 1 to 12 carbon atoms, an aryl group optionally containing a substituent, a heterocyclic group optionally containing a substituent, an ester group, a cycloalkyl group, an aralkyl group optionally containing a substituent, an allyl group, an amido group, an amino group, an acyl group, an alkenyl group, an alkynyl group, a carboxyl group, a carbonyl group, a carboxylic acid group, or a halogenated alkyl group in which the substituent represents a halogen atom, an alkyl group having from 1 to 6 carbon atoms, an alkoxy group having from 1 to 6 carbon atoms, a hydroxyl group, a cyano group, an amino group, a nitro group, or a halogenated alkyl group.

3. The photoreceptor for electrophotography according to claim 1, wherein the photosensitive layer is the outermost surface layer.

4. The photoreceptor for electrophotography according to claim 3, wherein the photosensitive layer is composed of a charge generation layer and a charge transport layer, and the charge transport layer is the outermost surface layer.

5. The photoreceptor for electrophotography according to claim 1, wherein a surface protective layer is provided on the photosensitive layer, and the surface protective layer is the outermost surface layer.

6. The photoreceptor for electrophotography according to claim 3, wherein the photosensitive layer is a positively charged single layer.

7. The photoreceptor for electrophotography according to claim 3, wherein the photosensitive layer is composed of a charge transport layer and a charge generation layer, and the charge generation layer is the outermost surface layer.

8. The photoreceptor for electrophotography according to claim 1, wherein the outermost surface layer contains the electron transport material in an amount of 10 parts by mass or less with respect to 100 parts by mass of the resin binder.

9. An electrophotographic device having mounted therein the photoreceptor for electrophotography according to claim 1.

10. The photoreceptor for electrophotography according to claim 1, wherein the partial structural formula ($A_1$) is selected from the group consisting of $A_{12}$, $A_{13}$, $A_{15}$, $A_{16}$, $A_{17}$, $A_{18}$, and $A_{19}$ below and the partial structural formula ($B_1$) is selected from the group consisting of $B_{12}$, $B_{13}$, $B_{15}$, $B_{16}$, $B_{17}$, $B_{18}$, and $B_{19}$ below:

$A_{12}$
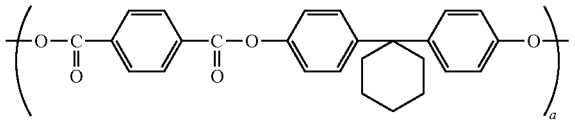
$A_{13}$
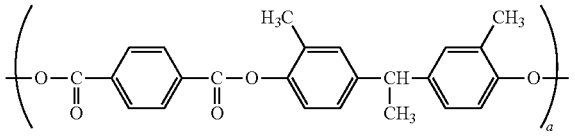
$A_{15}$
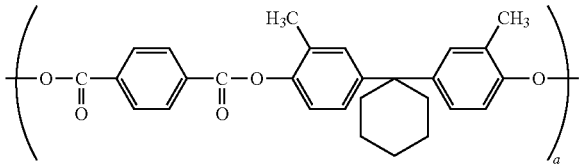
$A_{16}$
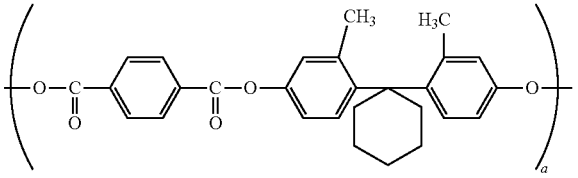
$A_{17}$
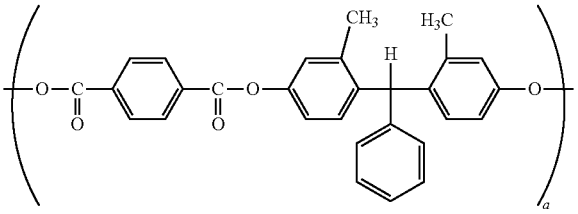
$A_{18}$
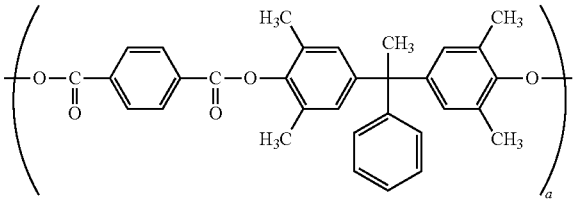
$A_{19}$
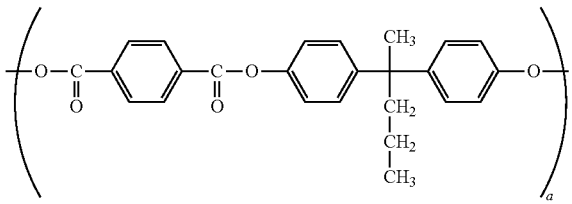
-continued
$B_{12}$
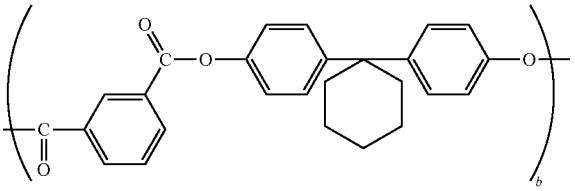
$B_{13}$
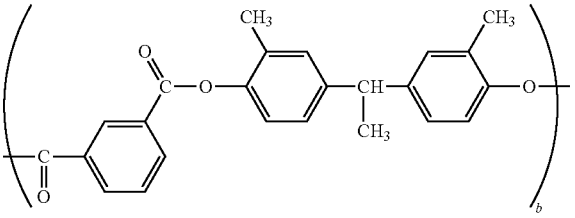
$B_{15}$
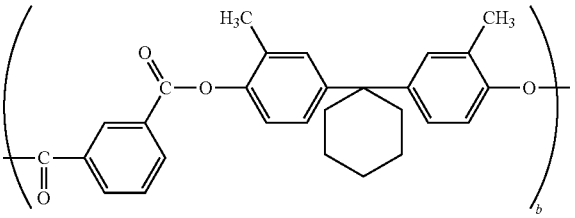
$B_{16}$
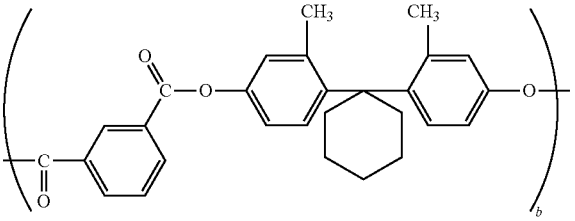
$B_{17}$
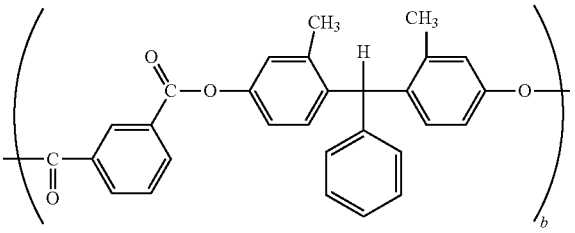
$B_{18}$
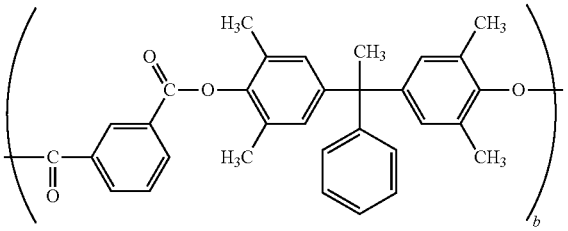

-continued $B_{19}$

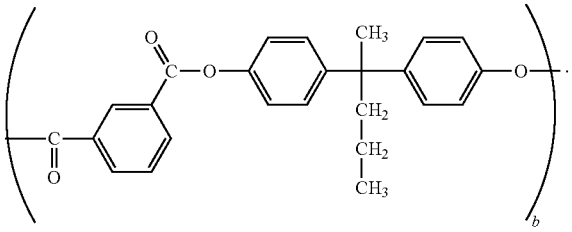

11. The photoreceptor for electrophotography according to claim 1, wherein the partial structural formula ($A_2$) is selected from the group consisting of $A_{20}$, $A_{21}$, $A_{22}$, $A_{23}$, $A_{24}$, $A_{25}$, $A_{26}$, $A_{27}$, $A_{28}$, and $A_{29}$ below and the partial structural formula ($B_2$) is selected from the group consisting of $B_{20}$, $B_{21}$, $B_{22}$, $B_{23}$, $B_{24}$, $B_{25}$, $B_{26}$, $B_{27}$, $B_{28}$, and $B_{29}$ below:

$A_{20}$

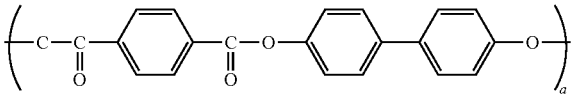

$A_{21}$

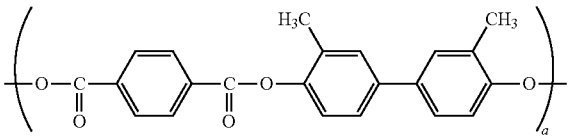

$A_{22}$

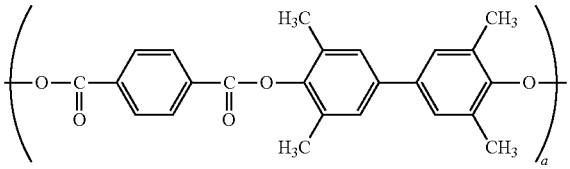

$A_{23}$

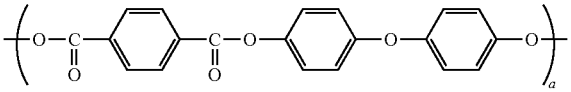

$A_{24}$

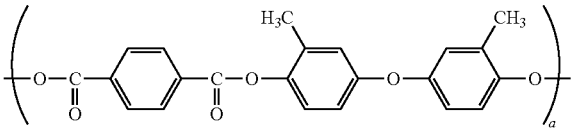

$A_{25}$

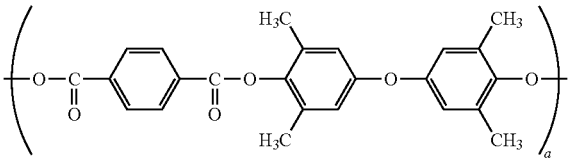

-continued $A_{26}$

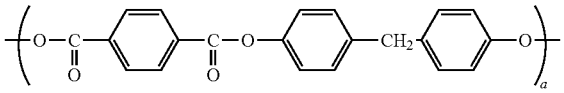

$A_{27}$

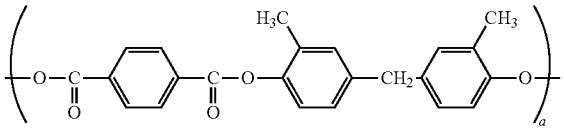

$A_{28}$

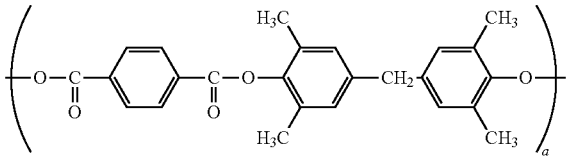

$A_{29}$

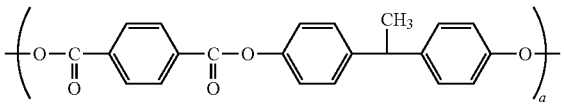

$B_{20}$

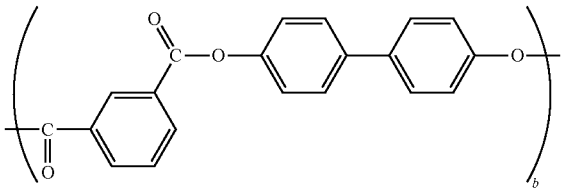

$B_{21}$

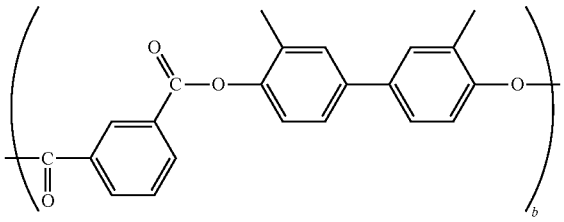

$B_{22}$

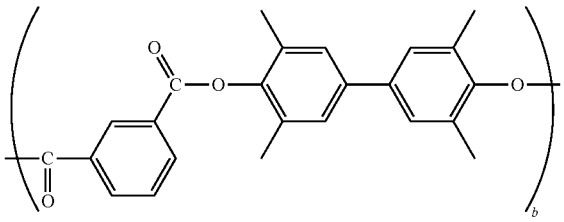

-continued
$B_{23}$
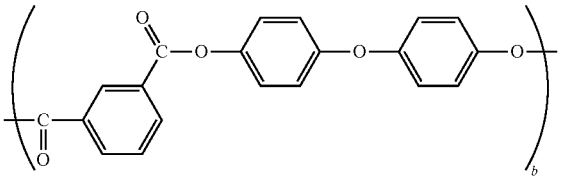
$B_{24}$
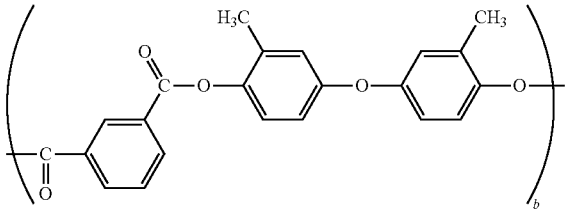
$B_{25}$
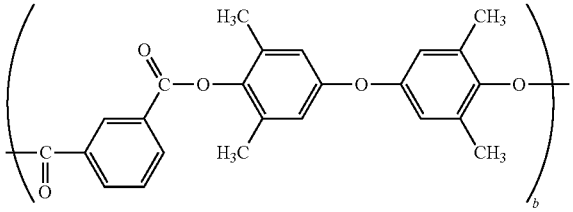
$B_{26}$
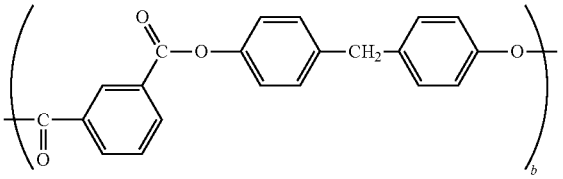
-continued
$B_{27}$
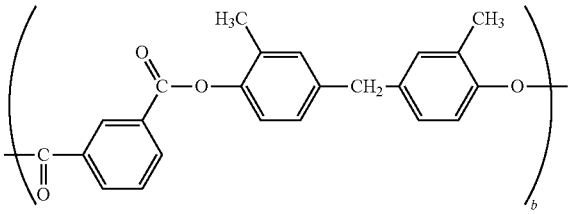
$B_{28}$
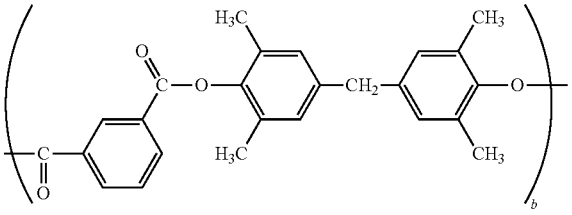
$B_{29}$
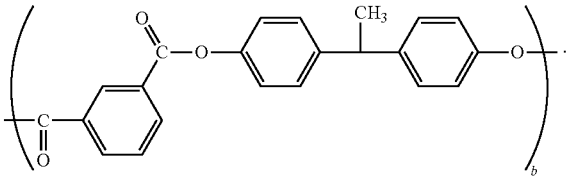
12. The photoreceptor for electrophotography according to claim 1, wherein the structural formula (C) is C1 below and the structural formula (D) is D1 below:
C1
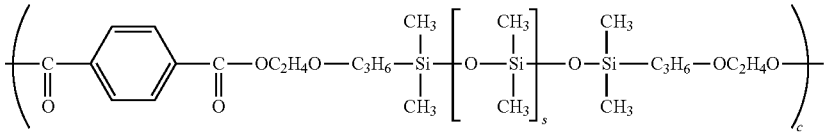
D1
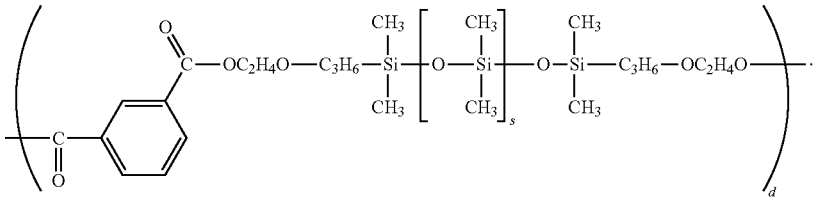

13. A method for manufacturing a photoreceptor for electrophotography, comprising:

forming a photosensitive layer on a conductive substrate including applying a coating liquid on the conductive substrate to form an outermost surface layer, the coating liquid containing a polyarylate resin having a structural unit represented by Chemical Structural Formula 1 below and a compound having a structure represented by General Formula (ET2-3) below, Chemical Structural Formula 1:

where partial structural formulae ($A_1$), ($A_2$), ($B_1$), ($B_2$), (C), (D), (E), and (F) represent respective structural units constituting the resin binder, $a_1$, $a_2$, $b_1$, $b_2$, c, d, e, and f represents mol % of the respective structural units ($A_1$), ($A_2$), ($B_1$), ($B_2$), (C), (D), (E), and (F), where $a_1$, $a_2$, $b_1$, and $b_2$ are not zero, where $a_1+a_2+b_1+b_2+c+d+e+f$ is 100 mol %, and where c+d+e+f range from greater than 0 up to 10 mol % and e and f are not both zero mol %;

$W_1$ and $W_2$ are different, ($A_1$)

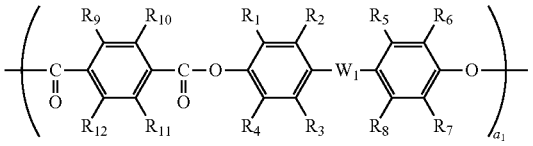

($A_2$)

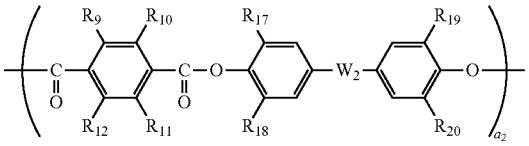

($B_1$)

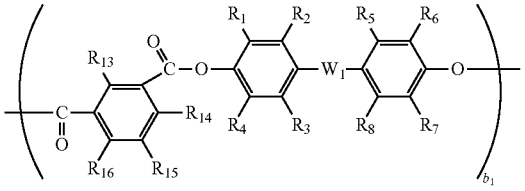

($B_2$)

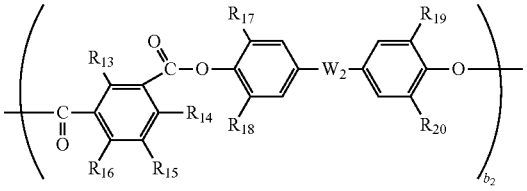

(C)

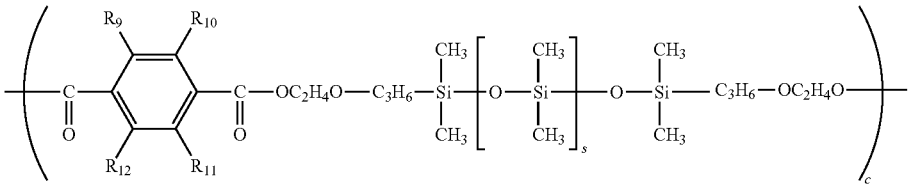

(D)

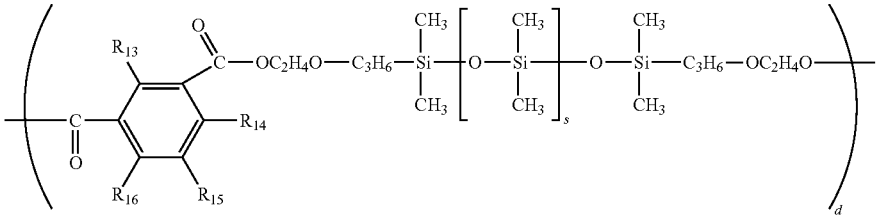

(E)

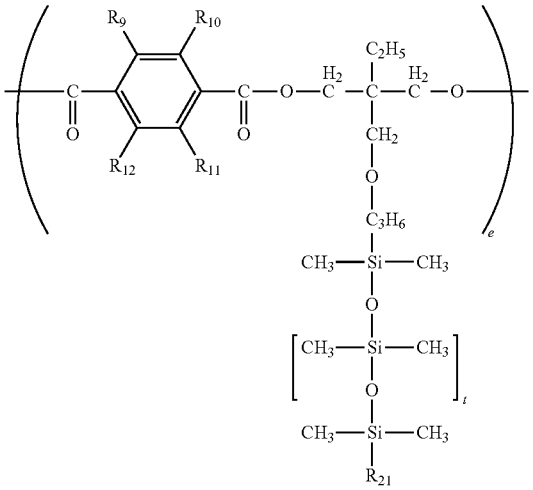

(F)

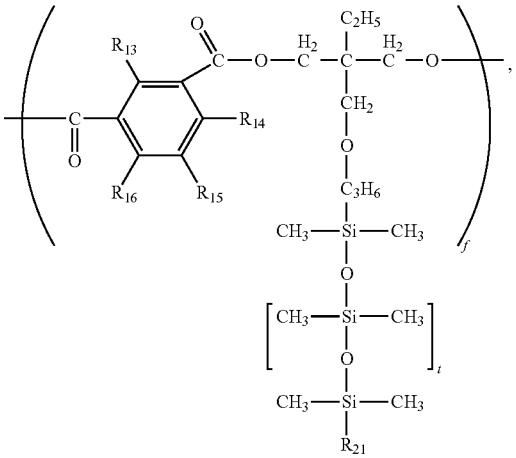

$W_1$ is selected from the group consisting of a single bond, —O—, and —$CR_{22}R_{23}$—, where C is a carbon atom and $R_{22}$ and $R_{23}$ are different, are monovalently bonded to the carbon atom of —$CR_{22}R_{23}$—, and are respectively selected from a monovalent group consisting of a hydrogen atom, an alkyl group having from 1 to 12 carbon atoms, a halogenated alkyl group, and a substituted or unsubstituted aryl group having from 6 to 12 carbon atoms; and $W_2$ is selected from the group consisting of a single bond, —O—, and —$CR_{22}R_{23}$—, where $R_{22}$ and $R_{23}$ are the same or different and are respectively selected from the group consisting of a hydrogen atom and an alkyl group having 1 carbon atom, wherein, in the partial structural formulas ($A_1$) and (B1), when the group $W_1$ is —$CR_{22}R_{23}$—, the groups $R_{22}$ and $R_{23}$ may bond together to form a cyclohexylidene group, and $R_1$ to $R_{20}$ are the same or different and are respectively selected from the group consisting of a hydrogen atom, an alkyl group having from 1 to 8 carbon atoms, a fluorine atom, a chlorine atom, and a bromine atom; $R_{21}$ represents a hydrogen atom, an alkyl group having from 1 to 20 carbon atoms, an aryl group optionally containing a substituent, a cycloalkyl group optionally containing a substituent, a fluorine atom, a chlorine atom, and a bromine atom, and s and t each represent an integer of 1 or more, and General Formula (ET2-3):

(ET2-3)

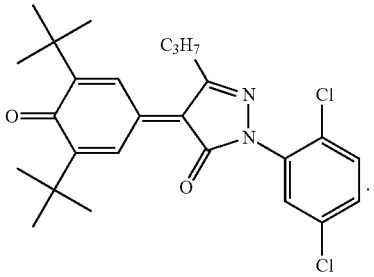

14. The method for manufacturing a photoreceptor for electrophotography according to claim 13, wherein the partial structural formula ($A_1$) is selected from the group consisting of $A_{12}$, $A_{13}$, $A_{15}$, $A_{16}$, $A_{17}$, $A_{18}$, and $A_{19}$ below and the partial structural formula ($B_1$) is selected from the group consisting of $B_{12}$, $B_{13}$, $B_{15}$, $B_{16}$, $B_{17}$, $B_{18}$, and $B_{19}$ below:

$A_{12}$

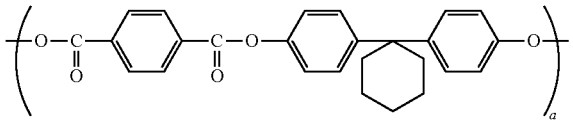

$A_{13}$

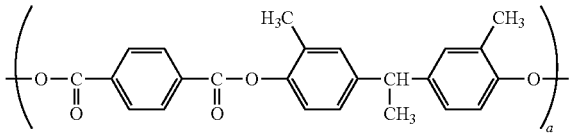

-continued $A_{15}$

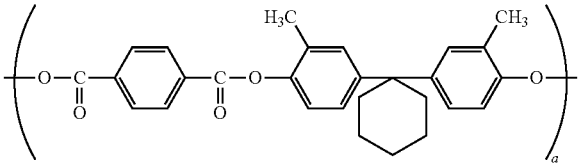

$A_{16}$

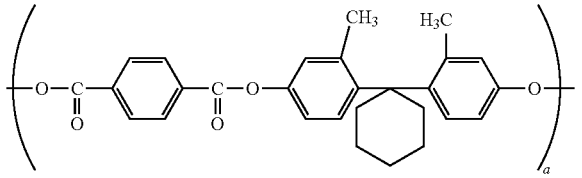

$A_{17}$

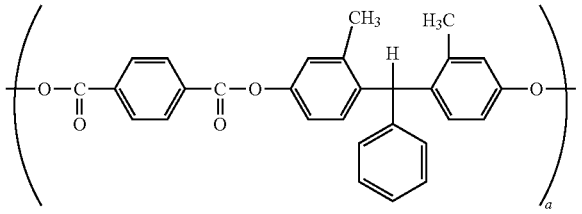

$A_{18}$

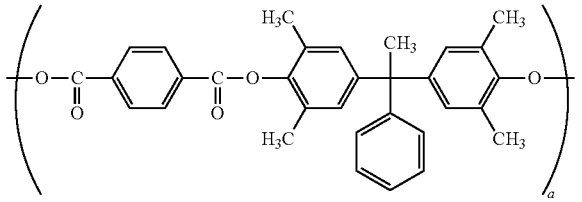

$A_{19}$

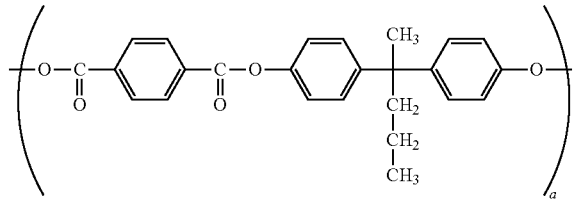

$B_{12}$

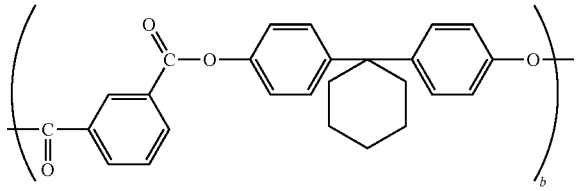

$B_{13}$

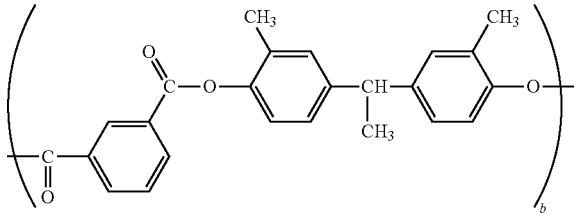

-continued $B_{15}$

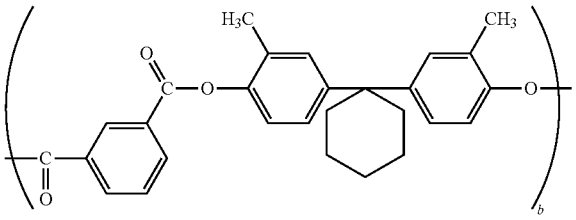

$B_{16}$

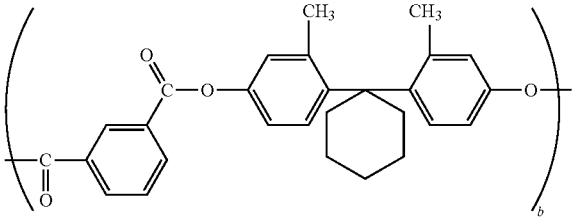

$B_{17}$

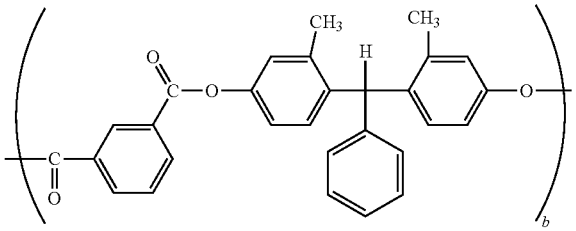

$B_{18}$

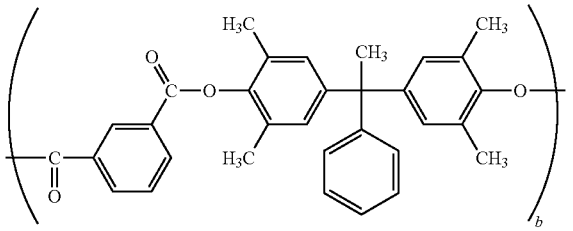

$B_{19}$

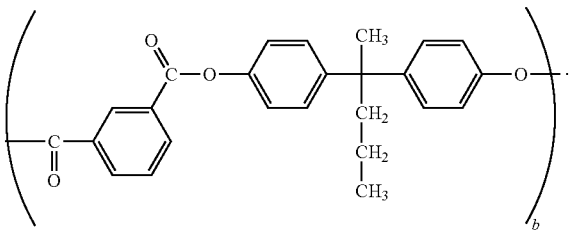

15. The method for manufacturing a photoreceptor for electrophotography according to claim 13, wherein the partial structural formula ($A_2$) is selected from the group consisting of $A_{20}$, $A_{21}$, $A_{22}$, $A_{23}$, $A_{24}$, $A_{25}$, $A_{26}$, $A_{27}$, $A_{28}$, and $A_{29}$ below and the partial structural formula ($B_2$) is selected from the group consisting of $B_{20}$, $B_{21}$, $B_{22}$, $B_{23}$, $B_{24}$, $B_{25}$, $B_{26}$, $B_{27}$, $B_{28}$, and $B_{29}$ below:

$A_{20}$

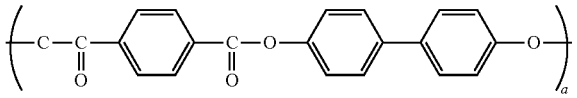

$A_{21}$

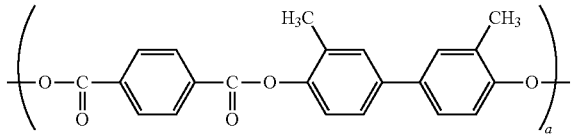

$A_{22}$

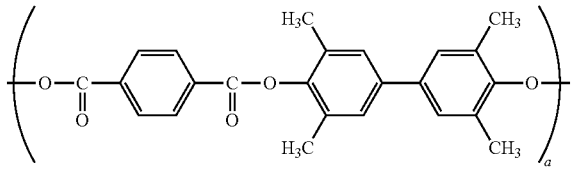

$A_{23}$

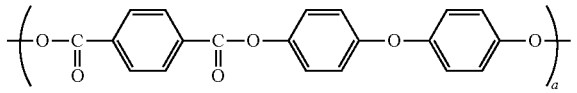

$A_{24}$

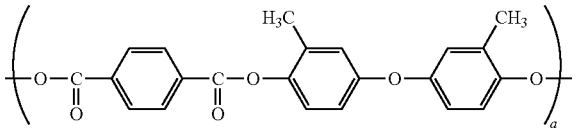

$A_{25}$

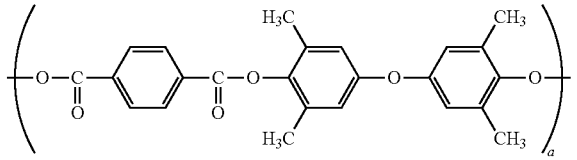

$A_{26}$

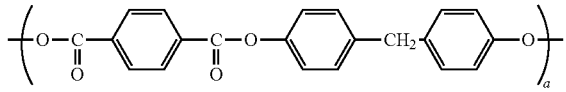

$A_{27}$

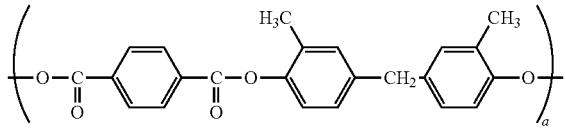

$A_{28}$

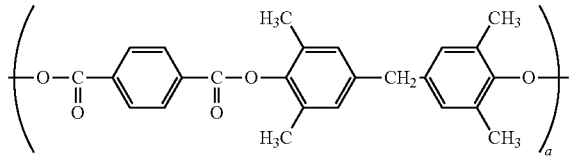

$A_{29}$

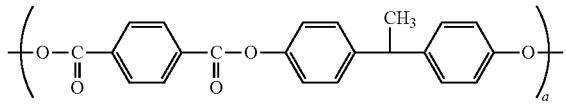

-continued
$B_{20}$
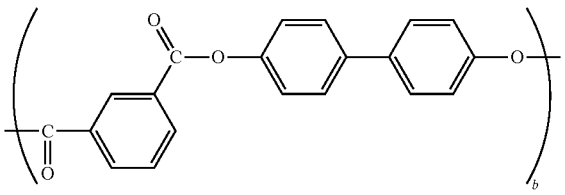
$B_{21}$
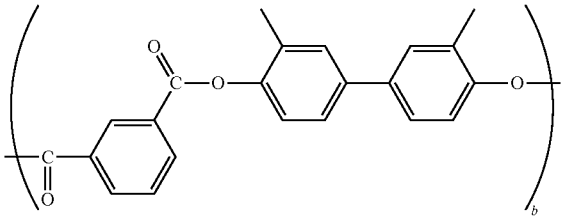
$B_{22}$
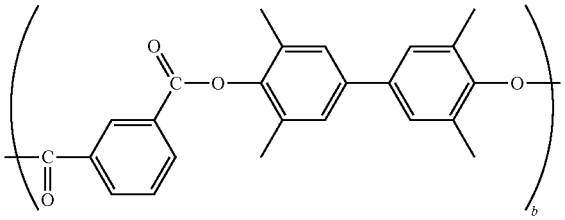
$B_{23}$
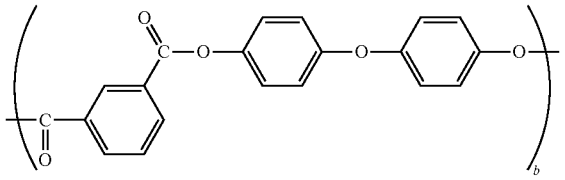
$B_{24}$
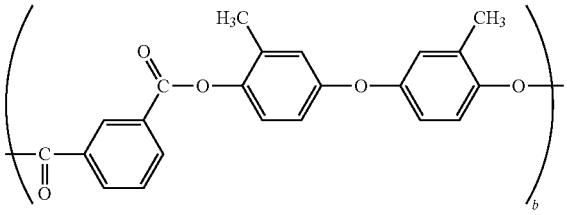
-continued
$B_{25}$
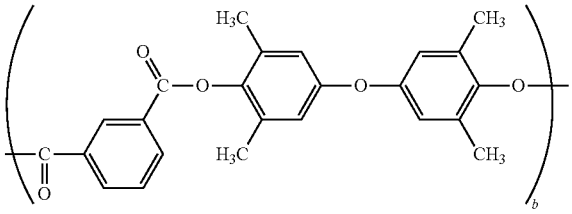
$B_{26}$
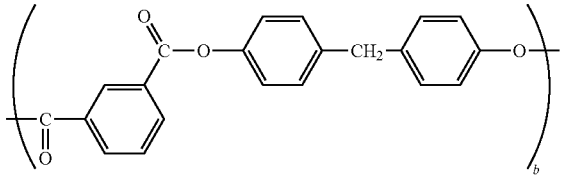
$B_{27}$
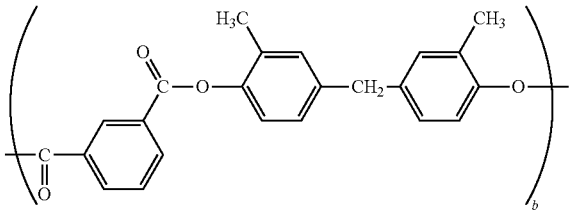
$B_{28}$
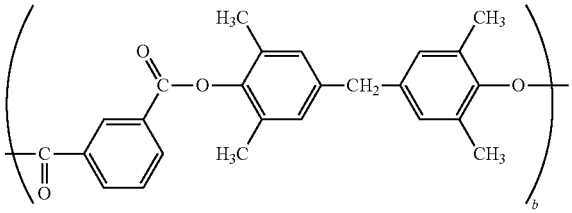
$B_{29}$
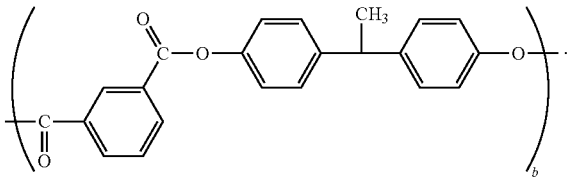
16. The method for manufacturing a photoreceptor for electrophotography according to claim 13, wherein the structural formula (C) is C1 below and the structural formula (D) is D1 below:
C1
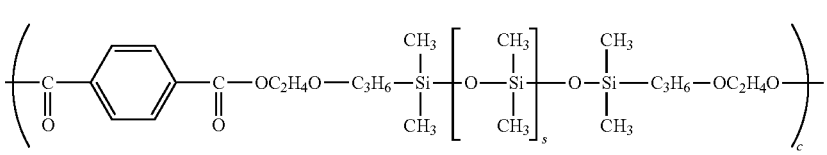

-continued
D1
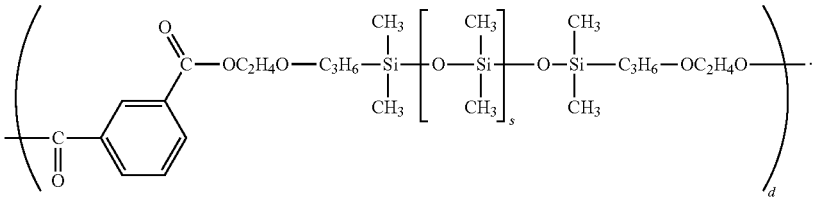
* * * * *